US012181171B2

(12) United States Patent
Liu

(10) Patent No.: US 12,181,171 B2
(45) Date of Patent: Dec. 31, 2024

(54) AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Fashen Liu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 277 days.

(21) Appl. No.: 17/779,085

(22) PCT Filed: Mar. 3, 2020

(86) PCT No.: PCT/CN2020/077635

§ 371 (c)(1),
(2) Date: May 23, 2022

(87) PCT Pub. No.: WO2021/134902

PCT Pub. Date: Jul. 8, 2021

(65) Prior Publication Data

US 2022/0412600 A1 Dec. 29, 2022

(30) Foreign Application Priority Data

Dec. 31, 2019 (CN) ..... 201911425288.6
Dec. 31, 2019 (CN) ..... 201922493953.7
(Continued)

(51) Int. Cl.
*F24F 11/89* (2018.01)
*F24F 11/63* (2018.01)

(52) U.S. Cl.
CPC ..... *F24F 11/89* (2018.01); *F24F 11/63* (2018.01)

(58) Field of Classification Search
CPC .... F24F 1/031; F24F 1/027; F24F 1/62; F24F 2221/20
See application file for complete search history.

(56) References Cited

U.S. PATENT DOCUMENTS 4,586,349 A * 5/1986 Ohishi ..... F24F 13/24 454/201
4,977,750 A * 12/1990 Metcalfe ..... F24F 1/027 62/298

(Continued)

FOREIGN PATENT DOCUMENTS

CN 203375615 U 1/2014
CN 203454264 U 2/2014

(Continued)

OTHER PUBLICATIONS

World Intellectual Property Organization (WIPO) International Search Report and Written opinion for PCT/CN2020/077635 Sep. 29, 2020 19 Pages (Translation Included).

(Continued)

*Primary Examiner* — Nelson J Nieves
(74) *Attorney, Agent, or Firm* — Anova Law Group, PLLC

(57) ABSTRACT

An air conditioner includes a chassis and an electric control box vertically installed on the chassis. The chassis includes a socket. The electric control box includes a pre-positioning member and a fixation structure provided at a bottom of the electric control box. The pre-positioning member corresponds to the socket. The pre-positioning member is configured to be inserted in the socket of the chassis to position the electric control box. The fixation structure is configured to connect and fix the electric control box to the chassis.

20 Claims, 28 Drawing Sheets

(30) Foreign Application Priority Data

Dec. 31, 2019 (CN) ..... 201922495049.X
Dec. 31, 2019 (CN) ..... 201922498992.6

(56) References Cited

U.S. PATENT DOCUMENTS

| | | | | | |
|---|---|---|---|---|---|
| 5,687,583 | A * | 11/1997 | Tunekawa | F24F 1/027 | 62/262 |
| 6,009,717 | A * | 1/2000 | Hernandez | F24F 1/027 | 62/262 |
| 6,182,460 | B1 * | 2/2001 | Hernandez | F24F 1/027 | 62/262 |
| 6,318,105 | B1 * | 11/2001 | Bushnell | F24F 1/027 | 62/262 |
| 6,321,553 | B1 * | 11/2001 | Bushnell | F24F 1/027 | 62/262 |
| 7,032,404 | B2 * | 4/2006 | Kim | F24F 13/20 | 62/262 |
| 8,763,416 | B2 * | 7/2014 | Hika | F24F 1/22 | 52/27 |
| 10,527,311 | B2 * | 1/2020 | Seo | F24F 13/30 | |
| 2009/0107162 | A1 * | 4/2009 | Su | F24F 13/32 | 62/263 |
| 2010/0212861 | A1 * | 8/2010 | Setsu | F24F 13/30 | 165/122 |
| 2017/0284683 | A1 * | 10/2017 | Gallo | F24F 13/0245 | |
| 2019/0024911 | A1 * | 1/2019 | Hayakawa | H05K 7/14 | |
| 2019/0072285 | A1 * | 3/2019 | Morikawa | F24F 13/30 | |
| 2019/0376698 | A1 * | 12/2019 | Pirmez | F25B 41/37 | |
| 2021/0190330 | A1 * | 6/2021 | Martinez Galvan | F24F 1/031 | |
| 2021/0356145 | A1 * | 11/2021 | Lei | F24F 13/32 | |
| 2022/0120450 | A1 * | 4/2022 | Wu | F24F 13/24 | |
| 2022/0228771 | A1 * | 7/2022 | Si | F24F 1/031 | |
| 2024/0085056 | A1 * | 3/2024 | Kim | F24F 1/0057 | |

FOREIGN PATENT DOCUMENTS

| | | | |
|---|---|---|---|
| CN | 205690537 | U | 11/2016 |
| CN | 107036178 | A | 8/2017 |
| CN | 207741276 | U | 8/2018 |
| CN | 208382360 | U | 1/2019 |
| CN | 109724167 | A | 5/2019 |
| CN | 109724169 | A | 5/2019 |
| CN | 109959132 | A | 7/2019 |
| CN | 211650494 | U | 10/2019 |
| CN | 209763320 | U | 12/2019 |
| CN | 209857330 | U | 12/2019 |
| CN | 111023321 | A | 4/2020 |
| CN | 111207451 | A | 5/2020 |
| CN | 111207452 | A | 5/2020 |
| CN | 111219798 | A | 6/2020 |
| CN | 111578387 | A | 8/2020 |
| CN | 211261045 | U | 8/2020 |
| CN | 211261046 | U | 8/2020 |
| CN | 211261055 | U | 8/2020 |
| KR | 20190004118 | A | 1/2019 |
| WO | WO-2017215123 | A1 * | 12/2017 |

OTHER PUBLICATIONS

China National Intellectual Property Administration (CNIPA) Office Action 1 for 201911425288.6 May 27, 2024 20 Pages (including translation).

* cited by examiner

AIR CONDITIONER

CROSS-REFERENCE TO RELATED APPLICATIONS

This application is a National Stage Entry under 35 U.S.C. § 371 of International Application No. PCT/CN2020/077635, filed on Mar. 3, 2020, which claims priority to Chinese Patent Application No. 201911425288.6, filed on Dec. 31, 2019, and entitled "AIR CONDITIONER," Chinese Patent Application No. 201922493953.7, filed on Dec. 31, 2019, and entitled "AIR CONDITIONER," Chinese Patent Application No. 201922495049.X, filed on Dec. 31, 2019, and entitled "AIR CONDITIONER," and Chinese Patent Application No. 201922498992.6, filed on Dec. 31, 2019, and entitled "ELECTRIC CONTROL BOX AND WINDOW AIR CONDITIONER," the entire contents of all of which are incorporated herein by reference.

TECHNICAL FIELD

The present disclosure relates to the technical field of air conditioners, and in particular, to an air conditioner.

BACKGROUND

In the related art, air conditioners are used to cool or heat the indoor environment. Usually, the air conditioner is configured with an electric control box, and the electric control box is generally fixed to the chassis by means of a plurality of screws and fasteners. However, the internal space of the air conditioner is relatively narrow, and the electric control box is fixed one by one in the interior of the air conditioner by means of a plurality of screws and fasteners, the installation operation is very cumbersome, which makes the installation difficult and leads to poor installation efficiency.

SUMMARY

The main purpose of the present disclosure is to provide an air conditioner, which aims to reduce the installation difficulty of the electric control box, and improve the installation efficiency of the electric control box.

In order to achieve the above objective, the present disclosure provides an air conditioner, including: a chassis; and an electric control box vertically installed on the chassis; wherein a bottom of the electric control box is provided with a pre-positioning member and a fixation structure, the chassis is provided with a socket corresponding to the pre-positioning member, the electric control box is configured to be positioned by the pre-positioning member inserted in the socket of the chassis, and then be connected and fixed to the chassis through the fixation structure.

In an embodiment, the electric control box includes a box body, the box body includes a bottom plate and a box cover adapted to cover the bottom plate, the bottom plate includes an outer metal bottom plate and an inner plastic bottom plate, the box cover includes an outer metal box cover and an inner plastic box cover, and the pre-positioning member is provided at the inner plastic bottom plate or on the inner plastic box cover.

In an embodiment, the air conditioner further includes a compressor arranged side by side with the electric control box, a notch is formed at one end of the bottom of the box body close to the compressor, and the pre-positioning member protrudes downward from the inner plastic bottom plate or the inner plastic box cover to one side of the notch.

In an embodiment, the fixation structure includes a fixation plate provided at the outer metal box cover and a fixation foot provided at the inner plastic bottom plate; and the fixation plate is opposite to the fixation foot, and both the fixation plate and the fixation foot are connected and fixed to the chassis.

In an embodiment, the pre-positioning member includes a positioning frame connected to the box body of the electric control box, and a plug board provided at a lower end of the positioning frame and extending laterally; and the socket of the chassis is provided with an insertion hole configured for the plug board to be inserted in.

In an embodiment, the insertion hole of the socket is flared; and a guide flange extends obliquely upward on an upper edge of the insertion hole.

In an embodiment, a connection rib is provided at the pre-positioning member; the connection rib includes a first rib extending from a side of the positioning frame in an up-down direction, and a second rib extending from a lower end of the first rib to an upper surface of the plug board.

In an embodiment, the upper surface of the insertion end of the plug board and/or the insertion end of the second rib is configured with a guide slope, and the guide slope is inclined from top to bottom along the insertion direction.

In an embodiment, the upper surface of the plug board is provided with a horizontal rib; the horizontal rib intersects the second rib vertically and horizontally; and the horizontal rib is configured to abut against an upper wall surface of the insertion hole for positioning.

In an embodiment, the bottom of the electric control box is further configured with a supporting member, the supporting member is suitable for supporting the electric control box, and a plurality of heat dissipation channels are formed on the supporting member.

In an embodiment, the electric control box further includes an electric control board, the electric control board is mounted at the inner plastic bottom plate, the inner plastic box cover is configured with a main cavity, and the main cavity is suitable for accommodating components on the electric control board.

In an embodiment, the electric control board is installed on the inner plastic bottom plate, the inner plastic bottom plate is hollowed out at a position corresponding to the electric control board, a grid bracket is formed at the hollowed position, and the grid bracket separates the electric control board and the outer metal bottom plate.

In an embodiment, the distance between the electric control board and the outer metal bottom plate is not less than 8 mm and not more than 18 mm.

In an embodiment, the inner plastic box cover is provided with a plurality of heat dissipation holes through the side wall corresponding to the main cavity, and the plurality of heat dissipation holes are spaced apart along the up-down direction; an upper water baffle protrudes from the upper edge of the heat dissipation hole, and/or a lower water baffle protrudes from the lower edge of the heat dissipation hole.

In an embodiment, the electric control box further includes an inductor, and the inductor passes through the inner plastic bottom plate and is fixed on the outer metal bottom plate; the inner plastic box cover is configured with an auxiliary cavity, and the auxiliary cavity is configured for accommodating the inductor.

In an embodiment, the outer metal bottom plate is recessed from its outer wall to its inner wall surface, and an installation platform for the inductor to be installed is formed on the inner side of the recessed position, a sink groove is formed on the outside of the recessed position, and the sink groove is suitable for accommodating the connection member of the inductor or the grounding member of the electric control box.

In an embodiment, the electric control box further includes a heat sink, the heat sink is mounted at one end of the electric control board and is located above the inductor. An accommodation groove is formed on the outer wall surface of the outer metal box cover at the position of the heat sink, and the groove wall of the accommodation groove is provided with an extension opening for the heat sink to extend to the accommodation groove.

In an embodiment, a sealing sleeve is arranged around the heat sink, and a plurality of annular ribs are arranged on the inner periphery of the extension opening of the box cover, and the plurality of annular ribs are suitable for abutting against the surface of the sealing sleeve.

In an embodiment, the outer metal box cover is formed with an opening at a position corresponding to the bottom of the accommodation groove; the electric control box further includes a metal cover plate configured to cover the opening.

In an embodiment, the air conditioner further includes a housing mounted at the chassis, a top plate of the housing is provided with a first fixation member located above the electric control box, the top of the electric control box is protruded with a first engagement member, and the first engagement member and the first fixation member are connected and fixed by a connection member.

In an embodiment, the top plate of the housing is provided with a second fixation member and a third fixation member; the air conditioner also includes a fan bracket mounted at the housing, the top surface of the fan bracket is protruded with a second engagement member and a third engagement member, the second engagement member and the second fixation member and the third engagement member and the third fixation member are connected and fixed by connection members.

In an embodiment, the inner plastic box cover of the electric control box is provided with a groove corresponding to the first engagement member, and the back of the inner plastic box cover is provided with a drainage groove extending downward from the groove to the bottom thereof.

In an embodiment, the air conditioner is a window air conditioner.

In an embodiment, a housing of the window air conditioner is configured with a separation groove for the shielding member located at the window of the wall to extend into, the housing is divided into an indoor housing and an outdoor housing by the separation groove, an indoor cavity is formed inside the indoor housing, and an outdoor cavity is formed inside the outdoor housing; and the electric control box is vertically installed on the outdoor housing.

In an embodiment, the window air conditioner further includes an indoor heat exchanger and an indoor fan installed in the indoor housing, and an outdoor heat exchanger and an outdoor fan installed in the outdoor housing.

In an embodiment, the air conditioner further includes a sealing member, the sealing member is movably mounted in the separation groove and the sealing member is switched between a storage state and a working state; the sealing member is stored in the separation groove in the storage state; and the sealing member is configured to protrude laterally from the separation groove in the working state, and is configured for the shielding member and/or an inner wall of the window to abut against.

In technical solutions of the present disclosure, a pre-positioning member and a fixation structure are provided at the bottom of the electric control box, and a socket corresponding to the pre-positioning member is provided in the chassis. When installing the electric control box, the electric control box can be inserted and connected to the socket of the chassis through the pre-positioning member first to realize the pre-positioning of the electric control box, and then connected and fixed with the chassis through the fixation structure. It can be seen that, in the air conditioner of the present disclosure, the electric control box is first inserted and positioned, so that the electric control box is not easy to move, which facilitates the subsequent fixing operation of the electric control box, the installation difficulty is low, and the installation efficiency is improved.

BRIEF DESCRIPTION OF THE DRAWINGS

In order to more clearly illustrate the embodiments of the present disclosure or the technical solutions in the existing technologies, the following briefly introduces the accompanying drawings that need to be used in the description of the embodiments or the existing technologies. Obviously, the drawings in the following description are only some embodiments of the present disclosure. For those of ordinary skill in the art, other drawings can also be obtained based on the structures shown in these drawings without any creative effort.

Description of reference numerals

Figure 1:
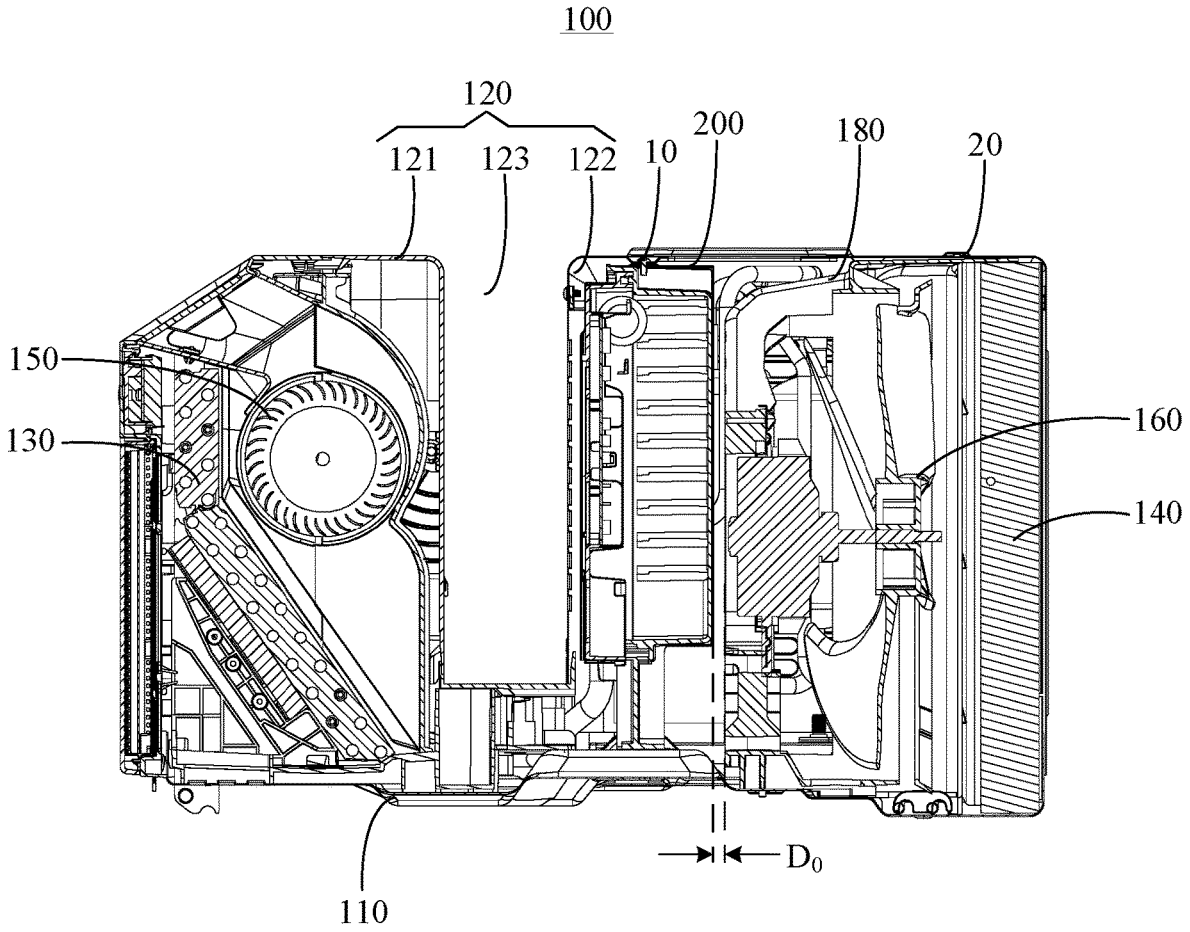
FIG. 1 is a schematic structural diagram of an air conditioner according to an embodiment of the present disclosure.

| Reference numeral | Name | Reference numeral | Name |
|---|---|---|---|
| 100 | air conditioner | 410 | hollowed-out position |
| 110 | chassis | 500 | outer metal box cover |
| 111 | socket | 520 | accommodation groove |
| 112 | guide flange | 600 | inner plastic box cover |
| 113 | first convex | 610 | pre-positioning member |
| 114 | second convex | 611 | positioning frame |
| 120 | housing | 612 | plug board |
| 121 | indoor housing | 613 | connection rib |
| 122 | outdoor housing | 6131 | first rib |
| 123 | separation groove | 6132 | second rib |
| 130 | indoor heat exchanger | 614 | horizontal rib |
| 140 | outdoor heat exchanger | 615 | guide slope |
| 150 | indoor fan | 620 | fixation foot |
| 160 | outdoor fan | 630 | support member |
| 170 | compressor | 640 | heat dissipation hole |
| 180 | fan bracket | 641 | water baffle |
| 200 | electric control box | 650 | extension opening |
| 210 | box body | 651 | annular rib |
| 211 | bottom plate | 660 | groove |
| 212 | box cover | 670 | drainage groove |
| 220 | electric control board | 690 | support rib |
| 230 | inductor | 601 | main cavity |
| 240 | heat sink | 602 | auxiliary cavity |
| 250 | metal cover plate | 580 | opening |
| 260 | sealing sleeve | 10 | first fixation member |
| 300 | outer metal bottom plate | 11 | first engagement member |
| 310 | fixation plate | 20 | second fixation member |
| 320 | installation platform | 21 | second engagement member |
| 330 | sink groove | 30 | third fixation member |
| 400 | inner plastic bottom plate | 31 | third engagement member |

The realization of the objective, functional characteristics, and advantages of the present disclosure are further described with reference to the accompanying drawings.

DETAILED DESCRIPTION OF THE EMBODIMENTS

The technical solutions of the embodiments of the present disclosure will be described in more detail below with reference to the accompanying drawings. It is obvious that the embodiments to be described are only some rather than all of the embodiments of the present disclosure. All other embodiments obtained by persons skilled in the art based on the embodiments of the present disclosure without creative efforts shall fall within the scope of the present disclosure.

It should be noted that if there is a directional indication (such as up, down, left, right, front, rear . . . ) in the embodiments of the present disclosure, the directional indication is only used to explain the relative positional relationship, movement, etc. of the components in a certain posture (as shown in the drawings). If the specific posture changes, the directional indication will change accordingly.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

The present disclosure provides an air conditioner. The air conditioner is suitable for cooling or heating an indoor environment. The air conditioner can be an air conditioner indoor unit or an air conditioner outdoor unit, or a window air conditioner. The window air conditioner is suitable for being installed at a window of a wall. In order to avoid redundant description, in the following embodiments, the air conditioner is mainly a window air conditioner as an example for detailed description, and other models can be referred to for implementation.

Figure 2:
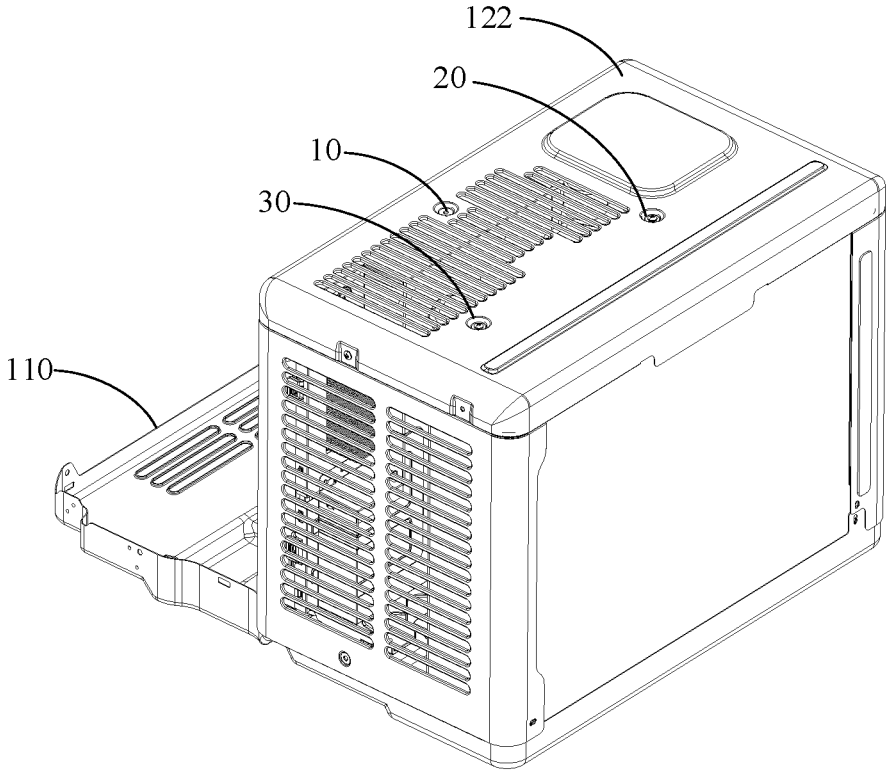
FIG. 2 is a partial schematic structural diagram of the air conditioner in FIG. 1.
Figure 3:
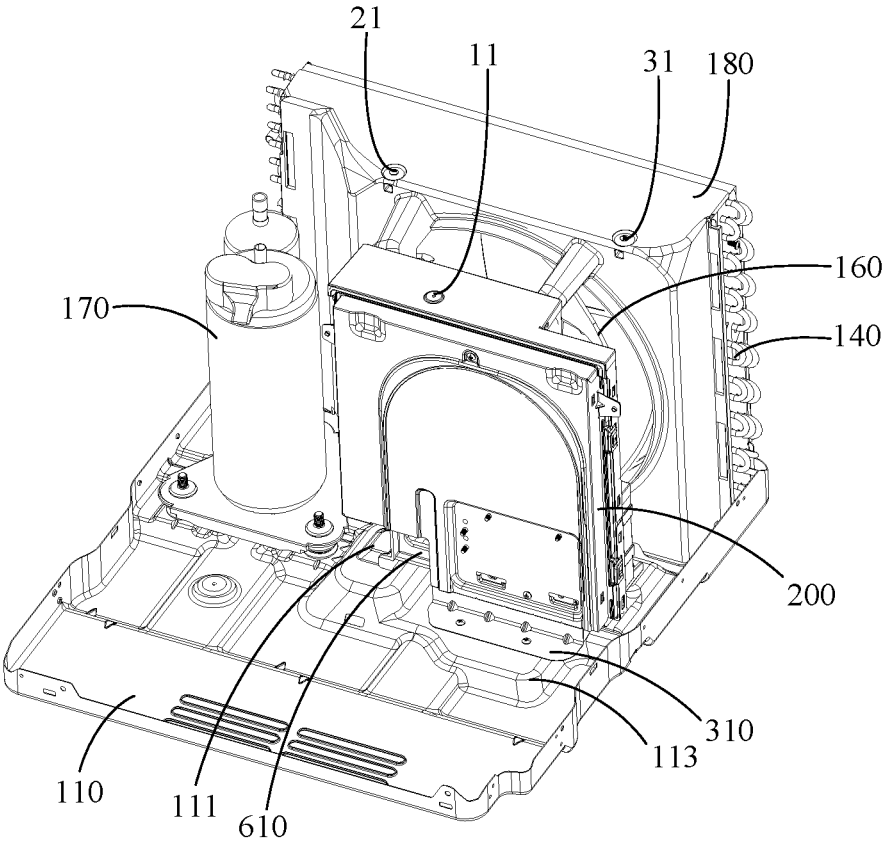
FIG. 3 is a schematic structural diagram of another part of the air conditioner in FIG. 2.

As shown in FIG. 1 to FIG. 3, in an embodiment of the present disclosure, an air conditioner 100 includes a chassis 110 and an electric control box 200 vertically installed on the chassis 110. A bottom of the electric control box 200 is provided with a pre-positioning member 610 and a fixation structure, the chassis 110 is provided with a socket 111 corresponding to the pre-positioning member 610, the electric control box 200 is inserted and positioned with the socket 111 of the chassis 110 through the pre-positioning member 610, and connected and fixed to the chassis 110 through the fixation structure.

The air conditioner 100 further includes a housing 120, an indoor heat exchanger 130, an outdoor heat exchanger 140, an indoor fan 150 and an outdoor fan 160. The housing 120 is mounted at the chassis 110, and the housing 120 includes an indoor housing 121 and an outdoor housing 122. The indoor heat exchanger 130 and the indoor fan 150 are installed in the indoor housing 121; the outdoor heat exchanger 140 and the outdoor fan 160 are installed in the outdoor housing 122. When the air conditioner 100 is working, the indoor fan 150 drives the indoor air into the indoor housing 121 to exchange heat with the indoor heat exchanger 130, blows the heat-exchanged air out from the indoor housing 121 to the indoor environment, so as to achieve cooling or heating of the indoor environment. At the same time, the outdoor fan 160 drives the outdoor air into the outdoor housing 122 to exchange heat with the outdoor heat exchanger 140, and blows the heat-exchanged air out of the outdoor housing 122 to the outdoor environment.

The electric control box 200 is vertically installed on the outdoor housing 122, and the electric control box 200 is located on the air intake side of the outdoor fan 160 and is arranged side by side with the compressor 170 of the air conditioner 100. Therefore, one end of the electric control box 200 is close to the compressor 170, and the position is relatively narrow, making it difficult to perform installation operations. The pre-positioning member 610 can be provided at one end of the electric control box 200 close to the compressor 170, and the pre-positioning member 610 can be inserted and connected to the socket 111 of the chassis 110 without screwing, which is simple and easy to operate.

When the electric control box 200 is installed, it is possible to firstly insert the pre-positioning member 610 of the electric control box 200 corresponding to the socket 111 of the chassis 110, such that the electric control box 200 is positioned on the chassis 110, and then the fixation structure of the electric control box 200 is connected and fixed to the chassis 110. That is to say, the electric control box 200 is inserted and positioned first, so that the electric control box 200 is not easy to move, and the subsequent fixing operation of the electric control box 200 is convenient. The installation difficulty is low, the operation is extremely convenient, and it is beneficial to improve the installation efficiency.

In technical solutions of the present disclosure, the pre-positioning member 610 and the fixation structure are provided at the bottom of the electric control box 200, and the socket 111 corresponding to the pre-positioning member 610 is provided in the chassis 110, such that when the electric control box 200 is installed, the electric control box 200 can be inserted and connected to the socket 111 of the chassis 110 through the pre-positioning member 610 first, the electric control box 200 is pre-positioned, and then connected and fixed with the chassis 110 through the fixation structure. It can be seen that, in the air conditioner 100 of the present disclosure, the electric control box 200 is first inserted and positioned, so that the electric control box 200 is not easy to move, and the subsequent fixing operation of the electric control box 200 is convenient, the installation difficulty is low, and the installation efficiency is improved.

Figure 6:
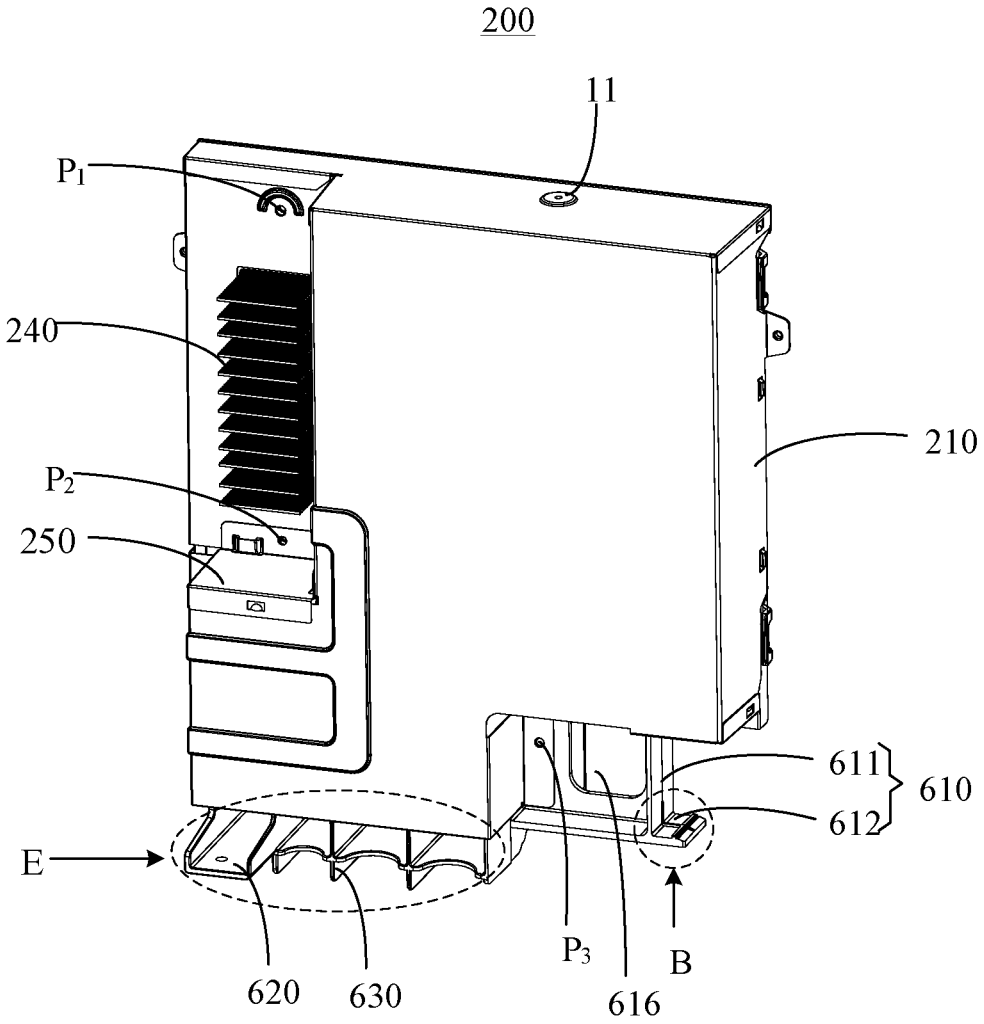
FIG. 6 is a schematic structural diagram of the electric control box of the air conditioner according to an embodiment of the present disclosure.
Figure 11:
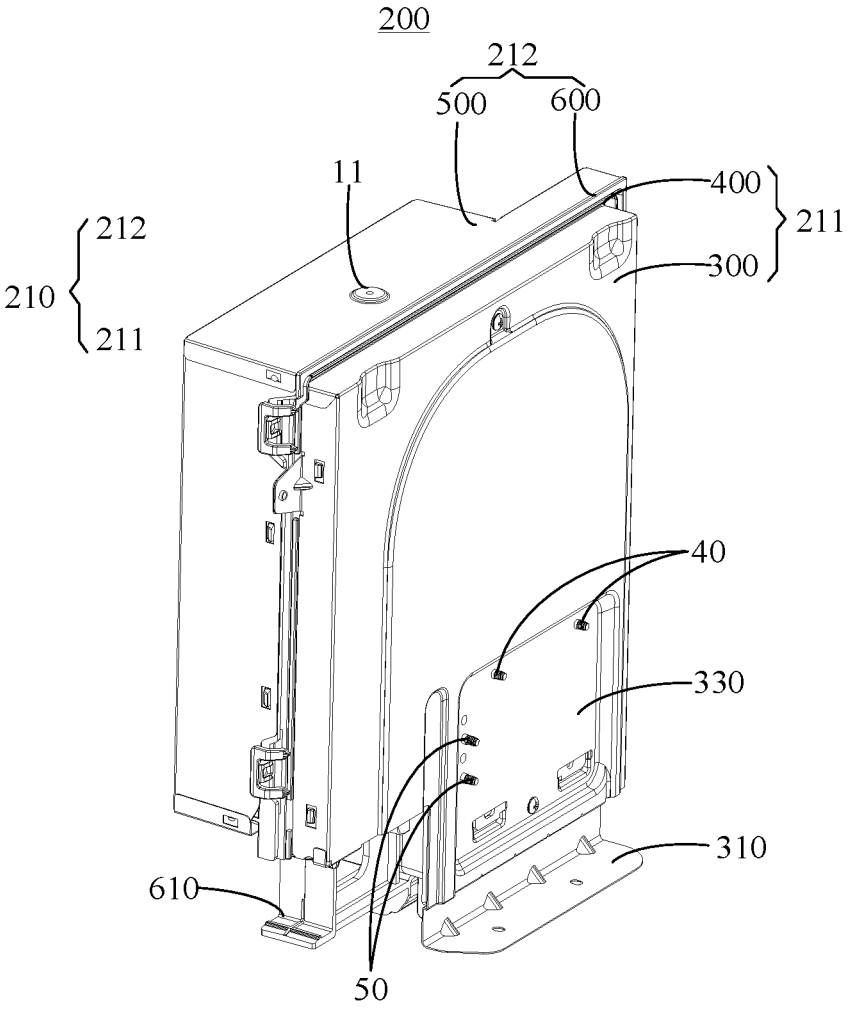
FIG. 11 is a schematic structural diagram of the electric control box from another perspective in FIG. 6.
Figure 12:
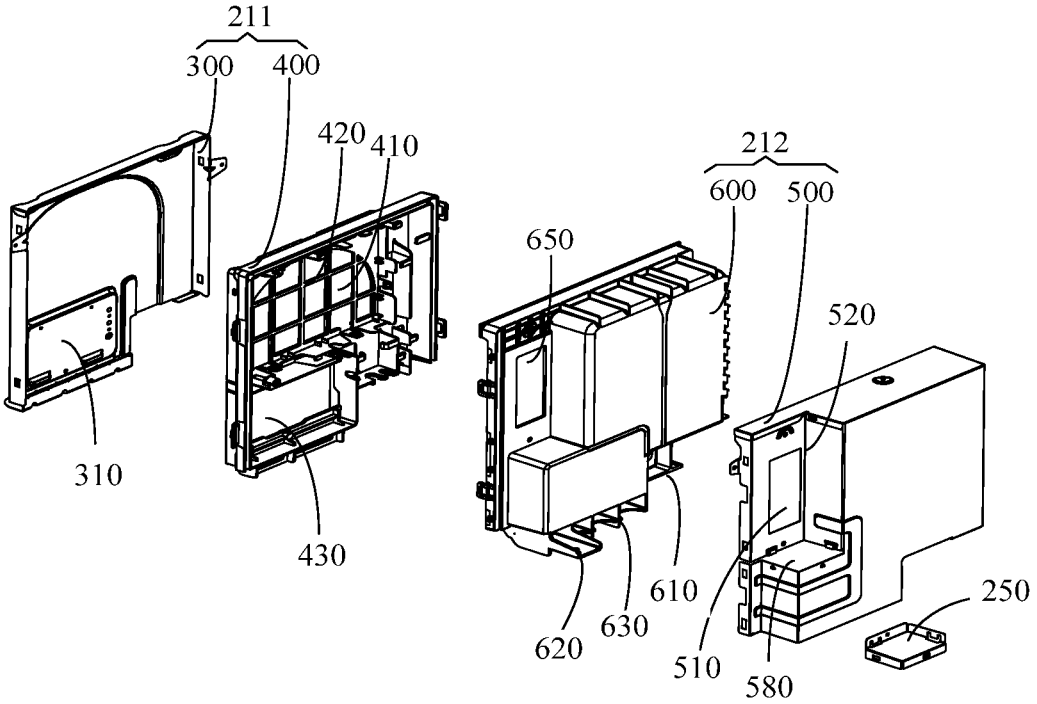
FIG. 12 is a schematic exploded view of the structure of a box body of the electric control box in FIG. 11.

As shown in FIG. 6, FIG. 11 and FIG. 12, in an embodiment, the electric control box 200 includes a box body 210, the box body 210 includes a bottom plate 211 and a box cover 212 adapted to cover the bottom plate 211, the bottom plate 211 includes an outer metal bottom plate 300 and an inner plastic bottom plate 400, the box cover 212 includes an outer metal box cover 500 and an inner plastic box cover 600, and the pre-positioning member 610 is provided at the inner plastic bottom plate 400 or on the inner plastic box cover 600.

The outer metal bottom plate 300 and the inner plastic bottom plate 400 of the bottom plate 211 are fixed as a whole by a snap structure or a screw structure. The outer metal box cover 500 and the inner plastic box cover 600 of the box cover 212 may also be fixed as a whole through a snap structure or a screw structure. That is, the box body 210 of the electric control box 200 actually has an inner portion and an outer portion. The inner portion is composed of the inner plastic bottom plate 400 and the inner plastic box cover 600; the outer portion is composed of the outer metal bottom plate 300 and the outer metal box cover 500. The outer portion can be made of rust-proof sheet metal.

The pre-positioning member 610 is provided at the inner portion (i.e., the lower end of the inner plastic bottom plate 400 or the lower end of the inner plastic box cover 600), mainly for two reasons. On the one hand, the inner portion directly receives the heat emitted by the electronic control element inside the electric control box 200, and the inner portion can be directly conducted to the pre-positioning member 610, so that there is no need for indirect heat transfer through the outer portion, and the heat dissipation is fast. On the other hand, the inner portion is made of plastic, which is low in cost and easy to form, so it is convenient for the pre-positioning member 610 to be integrally formed with the inner portion.

As shown in FIG. 6, FIG. 11 and FIG. 12, the air conditioner 100 further includes a compressor 170 arranged side by side with the electric control box 200. One end of the bottom of the box body 210 close to the compressor 170 is provided with a notch. The pre-positioning member 610 protrudes downward from the inner plastic bottom plate 400 or the inner plastic box cover 600 to one side of the notch.

The top wall or side wall of the notch is provided with a wire hole. The wires inside the electric control box 200 pass through the wire hole to a position of the notch, then, are pulled from the notch to the electronic control components of the air conditioner 100 (e.g., a display panel, or an outdoor temperature sensor, or an indoor temperature sensor, or a discharge or return air temperature sensor of a compressor 170, etc.). Since the pre-positioning member 610 is directly inserted and connected to the socket 111 of the chassis 110, there is no need for the user to manually perform a connection operation (such as screwing) at this position. By providing the pre-positioning member 610 on one side of the notch, the space of the notch can be reasonably utilized, and the additional space occupied by the components can be reduced, thereby reducing the volume of the electric control box 200.

Figure 5:
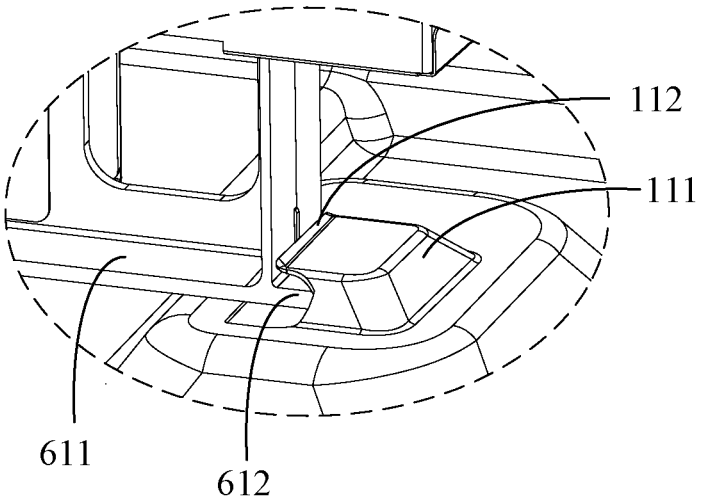
FIG. 5 is an enlarged view of portion A in FIG. 4.
Figure 7:
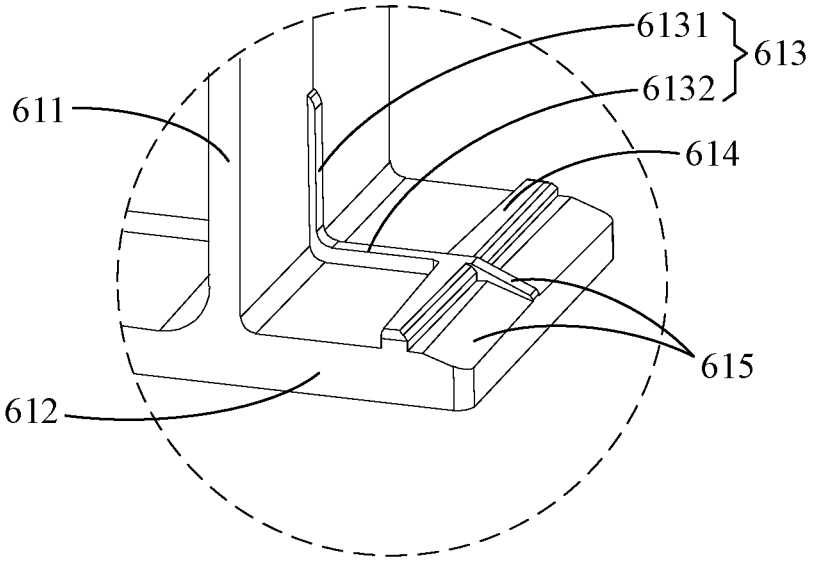
FIG. 7 is an enlarged view of portion B in FIG. 6.

As shown in FIG. 5 to FIG. 7, the specific assembly structure of the pre-positioning member 610 of the electric control box 200 and the socket 111 of the chassis 110 is not specifically limited herein. The pre-positioning member 610 includes a positioning frame 611 connected to the box body 210 of the electric control box 200, and a plug board 612 provided at a lower end of the positioning frame 611 and extending laterally. The socket 111 of the chassis 110 is provided with an insertion hole configured for the plug board 612 to be inserted in.

A heat dissipation channel is provided at the positioning frame 611. A part of the heat generated inside the electric control box 200 can be directly conducted to the pre-positioning member 610, and then emitted to the outside through the heat dissipation channel on the positioning frame 611. The plug board 612 is provided at the lower end of the positioning frame 611 to be inserted in the insertion hole on the socket 111 of the chassis 110.

In order to facilitate the insertion of the plug board 612 into the insertion hole, the insertion hole of the socket 111 can be flared, so that the resistance of the insertion hole to the plug board 612 is small. A guide flange 112 also extends obliquely upward on the upper edge of the insertion hole. The guide flange 112 guides the plug board 612 into the insertion hole, which greatly reduces the difficulty of inserting the plug board 612 into the socket 111.

As shown in FIG. 5 to FIG. 7, in an embodiment, after the plug board 612 of the pre-positioning member 610 is inserted in the socket 111, the upper surface of the plug board 612 abuts against the top wall of the insertion hole, the connection position between the plug board 612 and the positioning frame 611 is subjected to strong force, and it may be broken at this position. In order to avoid this situation, optionally, a connection rib 613 is also provided at the pre-positioning member 610, the connection rib 613 includes a first rib 6131 extending from the side of the positioning frame 611 in an up-down direction, and a second rib 6132 extending from the lower end of the first rib 6131 to the upper surface of the plug board 612.

The first rib 6131 of the connection rib 613 is connected to the second rib 6132 of the connection rib 613. That is to say, integrating the positioning frame 611 with the plug board 612 helps to improve the strength of the connection position between the plug board 612 and the positioning frame 611, so that the position is not easily broken. On the other hand, after the box body 210 of the electric control box 200 is integrally manufactured and formed, for example, the plug board 612 of the pre-positioning member 610 does not fit the socket 111 of the chassis 110, the plug board 612 of the pre-positioning member 610 can be adapted to the socket 111 of the chassis 110 by cutting the protruding height of the connection rib 613, such that it is unnecessary to modify the box body 210 of the electric control box 200 as a whole, which reduces rework procedures and helps to improve production efficiency.

As shown in FIG. 5 to FIG. 7, further, in order to reduce the difficulty of inserting the plug board 612 into the socket 111, a guide slope 615 may be configured on the upper surface of the insertion end of the plug board 612 and/or the insertion end of the second rib 6132, and the guide slope 615 is inclined from top to bottom along the insertion direction. In this way, the resistance of the insertion end of the plug board 612 can be reduced, so that the insertion end of the plug board 612 can be smoothly inserted into the insertion hole.

Besides, a horizontal rib 614 is also provided at the upper surface of the plug board 612. The horizontal rib 614 intersects the second rib 6132 vertically and horizontally, and the horizontal rib 614 is configured to abut against the upper wall surface of the insertion hole for positioning. The horizontal rib 614 can increase the strength of the plug board 612, so that the plug board 612 is not easily deformed by bending. Similar to one of the aforementioned connection ribs 613, after the box body 210 of the electrical control box 200 is integrally fabricated and formed, if the plug board 612 of the pre-positioning member 610 does not fit the socket 111 of the chassis 110, the protruding height of the horizontal rib 614 can be cut to reduce, such that the plug board 612 of the pre-positioning member 610 is adapted to the socket 111 of the chassis 110 without having to modify the box body 210 of the electric control box 200 as a whole, reducing rework procedures and improving production efficiency.

Figure 4:
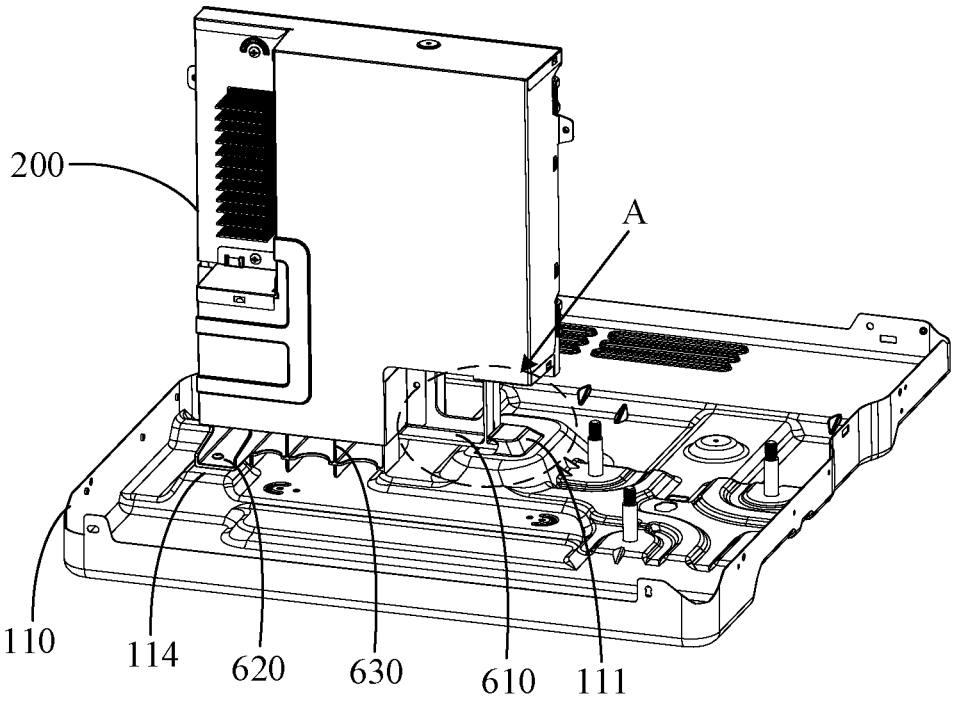
FIG. 4 is a schematic view of the assembly of an electric control box and a chassis in FIG. 3.

As shown in FIG. 3, FIG. 4 and FIG. 11, the fixation structure of the electric control box 200 and the specific assembling structure of the chassis 110 are not specifically limited herein. The fixation structure includes a fixation plate 310 provided at the outer metal box cover 500 and a fixation foot 620 provided at the inner plastic bottom plate 400; and the fixation plate 310 is opposite to the fixation foot 620, and is connected and fixed to the chassis 110.

The fixation plate 310 is integrally formed with the outer metal box cover 500, and extends laterally from the lower end of the outer metal box cover 500 to be connected and fixed with the chassis 110 by the connection member. The grounding member of the electrical control box 200 can be mounted at the outer metal box cover 500 and then grounded through the fixation plate 310 connected to the outer metal box cover 500. The fixation foot 620 is integrally formed with the inner plastic bottom plate 400, and the heat generated by the electric control components inside the electric control box 200 can be directly conducted from the inner plastic bottom plate 400 to the support member 630, and then radiated out through the support member 630. A first convex portion 613 and a second convex portion 614 are formed on the chassis 110. The fixation plate 310 and the first convex portion 613 are connected by the connection member. The fixation foot 620 and the second convex portion 614 are connected by the connection member. The connection member can be a screw.

After the electric control box 200 is fixed by the pre-positioning member 610, the end of the electric control box 200 away from the pre-positioning member 610 is close to the side wall of the chassis 110, such that the space between the electric control box 200 and the side wall of the chassis 110 is small, which is inconvenient for the user's hand to reach in to fix the electric control box 200. Therefore, the fixation plate 310 and the fixation foot 620 are respectively provided at opposite sides of the electric control box 200, so that when the electric control box 200 is fixed by the pre-positioning member 610, the space on both sides of the electrical control box 200 is relatively large, and is not interfered by the side walls of the chassis 110, and there is enough space for connecting and fixing the fixation plate 310 or the fixation foot 620 with the chassis 110.

Figure 13:
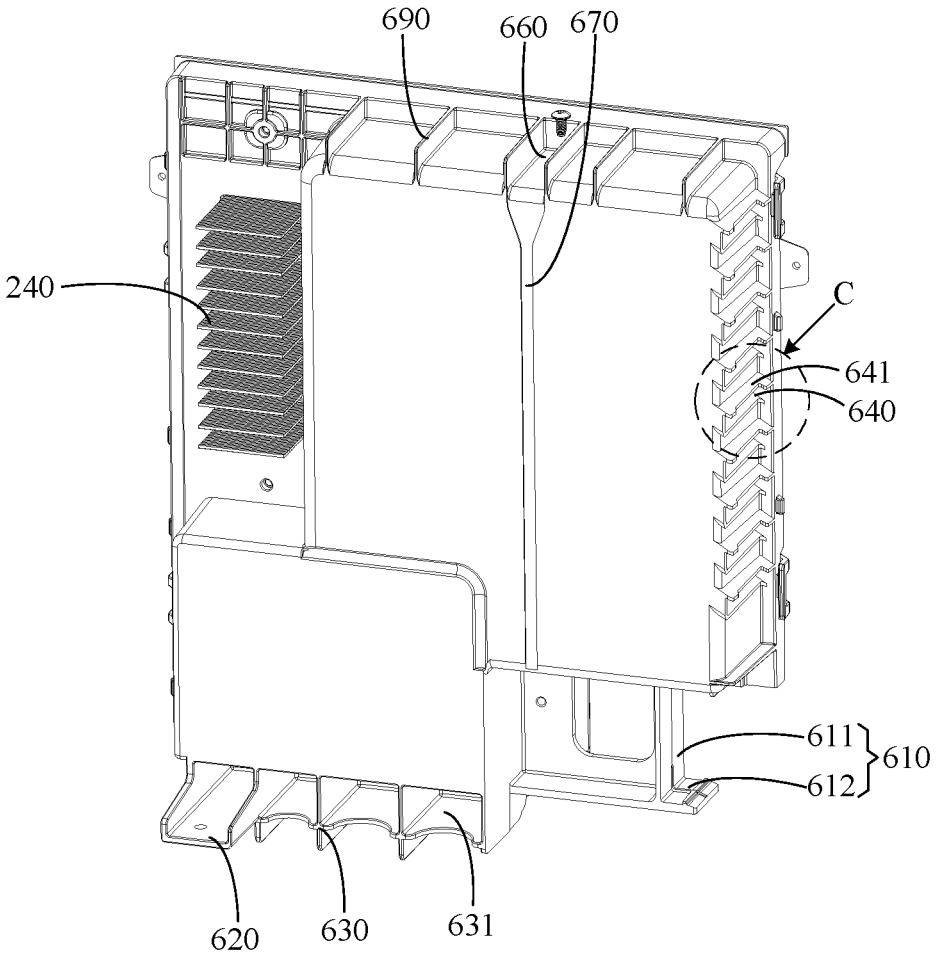
FIG. 13 is a schematic view of the electric control box in FIG. 11 after removing an outer metal box cover.

As shown in FIG. 13, in an embodiment, the bottom of the electric control box 200 is further provided with a support member 630 for supporting the electric control box 200, and a plurality of heat dissipation channels are formed on the support member 630. The support member 630 is integrally connected to the fixation foot 620, and the support member 630 includes a plurality of support plates extending downward from the bottom wall of the electric control box 200. A heat dissipation channel is formed at intervals between two adjacent support plates.

The plurality of support plates cooperate to support the electric control box 200, and the two opposite sides of the support plates form heat dissipation surfaces, so that the support member 630 has a larger heat dissipation area. When the air flow passes through the heat dissipation channel, the air flow takes away the heat conducted by the electric control box 200 to the heat dissipation surface of the support plate, and the heat dissipation effect is better.

Figure 15:
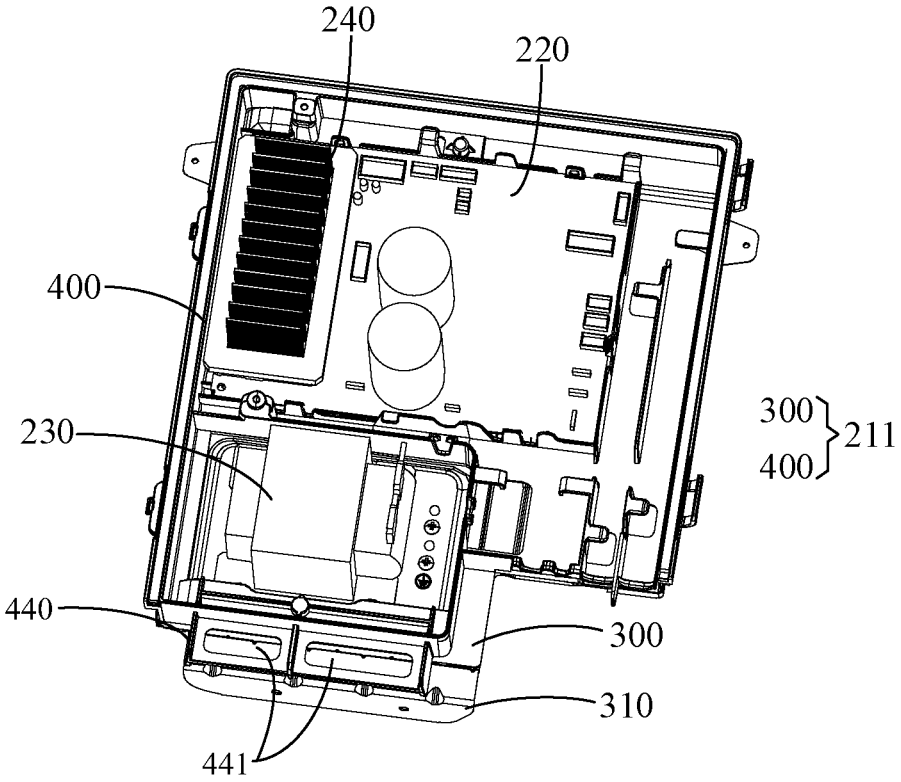
FIG. 15 is a schematic view of a base plate in FIG. 11 with electronic control components installed.
Figure 16:
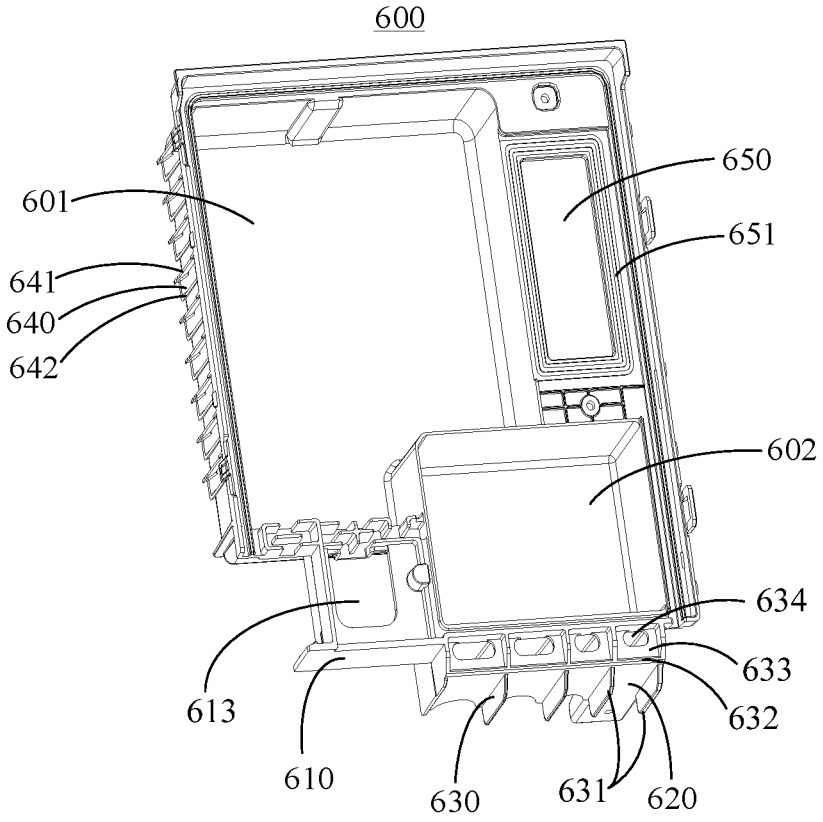
FIG. 16 is a schematic structural diagram of the inner plastic box cover in FIG. 11.
Figure 17:
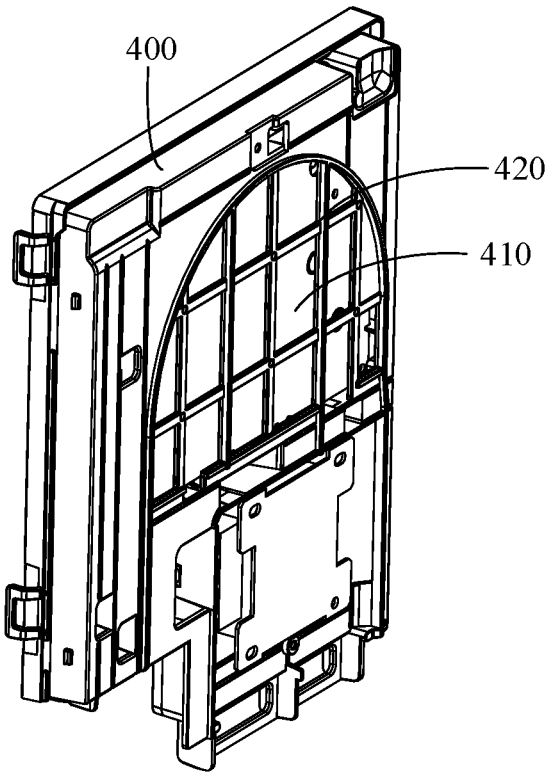
FIG. 17 is a schematic structural diagram of an inner plastic bottom plate in FIG. 11.

As shown in FIG. 15 to FIG. 17, based on any one of the above-mentioned embodiments, the electric control box 200 further includes an electric control board 220, and the electric control board 220 is installed on the inner plastic bottom plate 400, the inner plastic box cover 600 is provided with a main cavity 601 configured for accommodating components on the power supply control board 220. The electric control board 220 is mounted at the inner plastic bottom plate 400, the inner plastic bottom plate 400 is hollowed out at a position corresponding to the electric control board 220, and a grid bracket 420 is formed at the hollowed-out position 410. The grid bracket 420 is configured to separate the electric control board 220 and the outer metal bottom plate 300, so that a heat dissipation area is formed between the electric control board 220 and the outer metal bottom plate 300.

Figure 21:
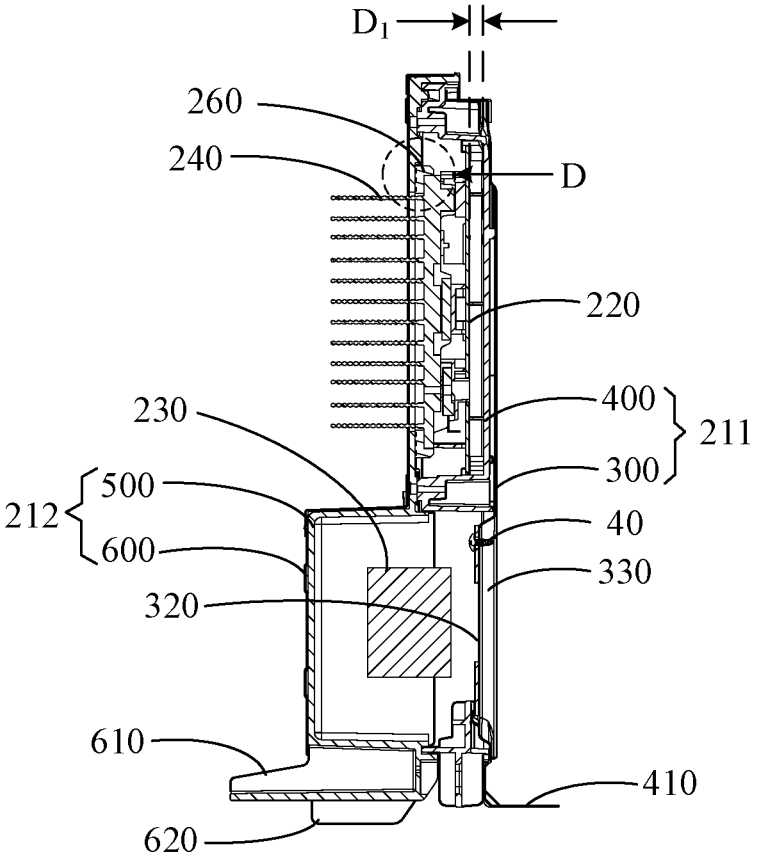
FIG. 21 is a schematic view of an internal structure of the electric control box in FIG. 6.

As shown in FIG. 21, D1 in FIG. 21 represents the distance between the electric control board 220 and the outer metal bottom plate 300. Theoretically speaking, the larger the distance between the electric control board 220 and the outer metal bottom plate 300, the more conducive to the airflow, and the more conducive to heat dissipation. However, the space of the electric control box 200 will be additionally occupied accordingly, so that the overall volume of the electric control box 200 will be increased. Therefore, the distance between the electric control board 220 and the outer metal bottom plate 300 should be kept within a certain range.

After research, it is concluded that when the distance between the electric control board 220 and the outer metal bottom plate 300 is not less than 8 mm and not more than 18 mm, a larger gap can be obtained between the electric control board 220 and the outer metal bottom plate 300, and the space occupied by the electric control box 200 is small, and the overall volume of the electric control box 200 can still be kept small.

In view of this, the distance between the electric control board 220 and the outer metal bottom plate 300 can be selected to be not less than 8 mm and not more than 18 mm, for example but not limited to: 8 mm, 10 mm, 12 mm, 15 mm, 16 mm, 17 mm, etc. Specifically, it can be designed according to the size of the electric control board 220, and no specific limitation is set here.

Figure 14:
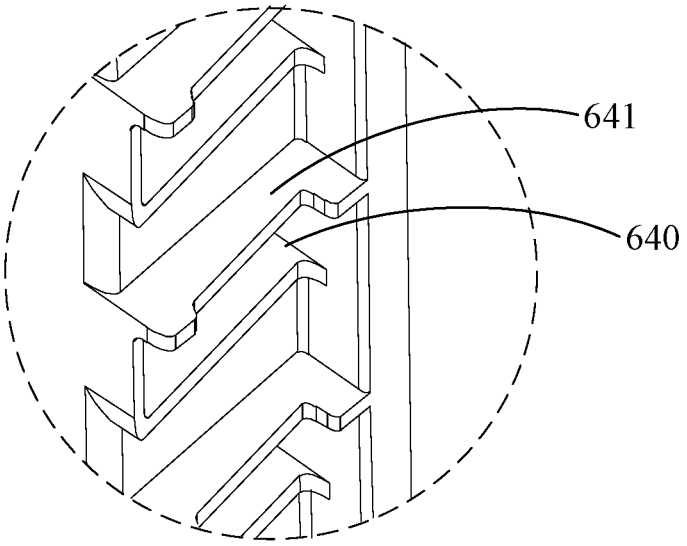
FIG. 14 is an enlarged view of portion C in FIG. 13.

As shown in FIG. 13 and FIG. 14, in an embodiment, considering that the main heat source of the electric control box 200 comes from the electric control board 220, the components on the electric control board 220 are accommodated in the main cavity 601 of the inner plastic box cover 600, and the heat transfer efficiency of the inner plastic box cover 600 is low, which is not conducive to heat dissipation. Therefore, a plurality of heat dissipation holes 640 may be formed through the inner plastic box cover 600 on the side wall corresponding to the main cavity 601, and the plurality of heat dissipation holes 640 are spaced apart in the up-down direction. The plurality of heat dissipation holes 640 can quickly dissipate the heat in the main cavity 601 to the gap between the inner plastic box cover 600 and the outer metal box cover 500, and then dissipate the heat outward through the outer metal box cover 500.

Besides, the moisture in the external environment may penetrate into the interior through the gaps on the box body 210 (such as the gaps between the outer metal bottom plate 300 and the outer metal box cover 500, or the pores at the connection position between the top of the box body 210 and the housing). Further, the moisture enters into the main cavity 601 from the heat dissipation hole 640, causing the electronic control board 220 to be damaged.

As shown in FIG. 13 and FIG. 11, in order to avoid this situation, a water baffle 641 can protrudes laterally on the periphery of the heat dissipation hole 640, and the water baffle 641 surrounds the heat dissipation hole 640. The water baffle 641 is inclined downward from the inner side of the heat dissipation hole 640 to the outer side thereof. Therefore, when the water in the external environment is on the side wall of the main cavity 601, it is shielded and guided by the water baffle 641 and drips down gradually, then flows to the bottom of the box body 210, and finally is discharged from the gap at the bottom of the box body 210 to the chassis 110. Therefore, water droplets are prevented from entering the main cavity 601 from the heat dissipation holes 640, and the occurrence of failure of the electronic control board 220 due to moisture is reduced.

As shown in FIG. 15 and FIG. 21, in an embodiment, the electrical control box 200 further includes an inductor 230, and the inductor 230 passes through the inner plastic bottom plate 400 and is fixed on the outer metal bottom plate 300. The inner plastic box cover 600 is provided with an auxiliary cavity 602, and the auxiliary cavity 602 is configured for accommodating the inductor 230. The outer metal bottom plate 300 is made of sheet metal parts, so compared with the inner plastic bottom plate 400, the outer metal bottom plate 300 has higher strength and is less prone to being bent. Therefore, the inductor 230 is fixed on the outer metal bottom plate 300, so that the outer metal bottom plate 300 can strongly support the inductor 230, and the outer metal bottom plate 300 is not easily deformed.

Further, in order to enhance the stability of installing the inductor 230, the outer metal bottom plate 300 is partially recessed from an outer wall surface thereof to an inner wall surface thereof. An installation platform 320 for mounting the inductor 230 is formed on the inner side of the recessed position, and a sink groove 330 is formed on the outer side of the recessed position. The sink groove 330 is suitable for accommodating the connection member 40 of the inductor 230 or the grounding member 50 of the electric control box 200. That is, after the connection member 40 of the fixed inductor 230 passes through the installation platform 320, the outer end of the connection member 40 is accommodated in the sink groove 330 and will not protrude from the outer wall surface of the box body 210, so that the operator or the housing 120 of the air conditioner 100 is not easily scratched.

In addition, the electrical control board 220 needs to be grounded through the grounding member 50, and the grounding member 50 (e.g., grounding screw) can be installed on the outer metal bottom plate 300 to be grounded through the outer metal bottom plate 300 (see FIG. 11). Similarly, in order to prevent the outer end of the grounding member from scratching the operator or the housing 120 of the air conditioner 100, the grounding member is also installed on the installation platform 320. The sink groove 330 is also configured for accommodating the grounding member 50.

Figure 23:
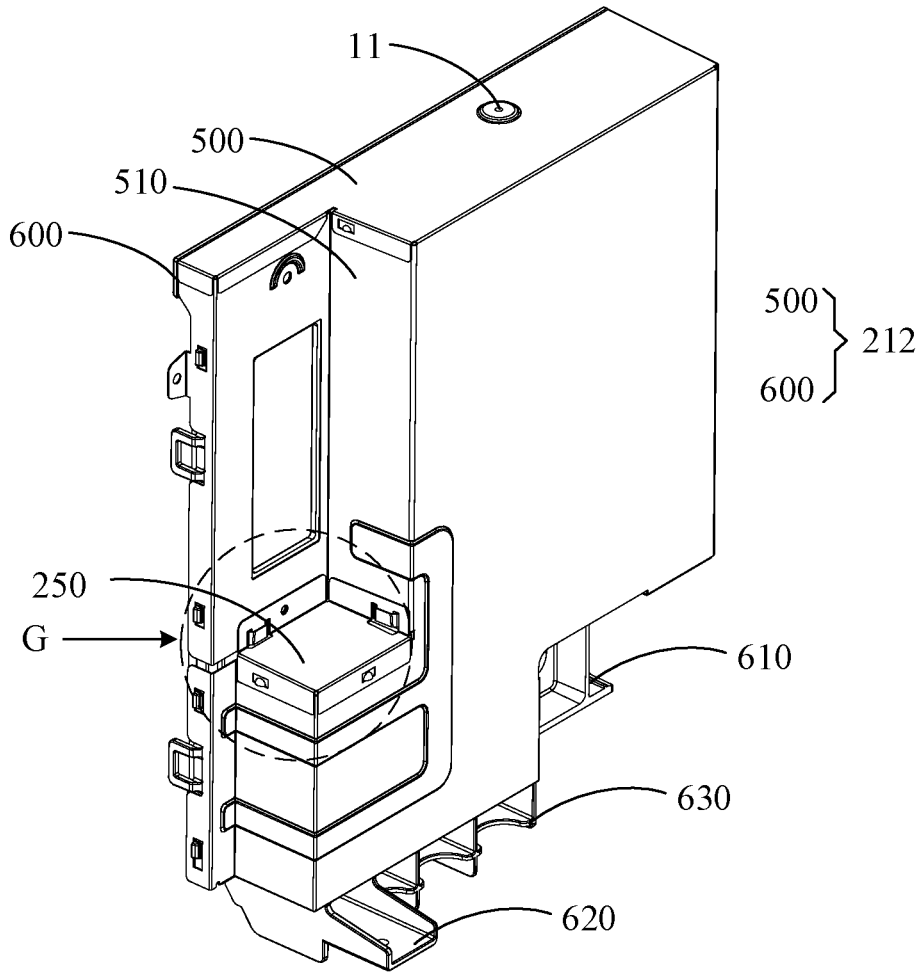
FIG. 23 is a schematic view of the assembly of the inner plastic box cover, the outer metal box cover and the metal cover plate of FIG. 16.

As shown in FIG. 6, FIG. 12 and FIG. 23, in an embodiment, the electrical control box 200 further includes a heat sink 240. The heat sink 240 is installed on one end of the electric control board 220, and is located above the inductor 230. An accommodation groove 520 is formed on the outer wall surface of the outer metal box cover 500 at the position of the heat sink 240. The groove wall of the accommodation groove 520 defines an extension opening 650 for the heat sink 240 to protrude into the accommodation groove 520. After the heat sink 240 is installed, the heat sink 240 protrudes from the inside of the box body 210 into the accommodation groove 520 through the extension opening 650, such that the heat sink 240 does not protrude from the outside of the electrical control box 200, and the heat sink 240 is exposed outside the electrical control box 200, which can effectively dissipate the heat generated by the electrical control board 220 to the outside of the box body 210.

Figure 22:
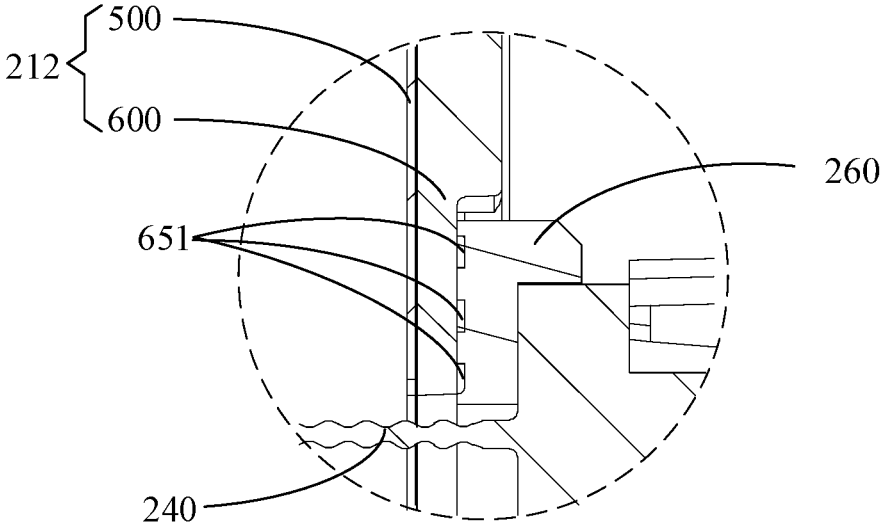
FIG. 22 is an enlarged view of portion D in FIG. 21.

As shown in FIG. 21 and FIG. 22, the circumference of the heat sink 240 is provided with a sealing sleeve 260, the inner periphery of the extension opening 650 of the box cover 212 is provided with a plurality of annular ribs 651, and the plurality of annular ribs 651 are suitable for abutting against the surface of the sealing sleeve 260. The plurality of annular ribs 651 abut against the surface of the sealing sleeve 260, so that the sealing sleeve 260 and the box cover 212 are tightly pressed against each other. Therefore, the gap between the extension opening 650 of the box cover 212 and the circumference of the heat sink 240 is sealed, preventing external water from falling into the box body 210 from the gap, and reducing the occurrence of failure of the electronic control board 220 due to moisture.

During the process of manufacturing the box body 210, due to the difficulty of mold manufacturing, it is not easy to form a groove wall at the bottom position of the outer metal box cover 500 corresponding to the accommodation groove 520. Instead, the outer metal box cover 500 is formed with an opening 580 at the bottom position corresponding to the accommodation groove 520. If the opening 580 is directly opened, the top of the auxiliary cavity 602 of the inner plastic box cover 600 will be exposed to the external environment, which does not meet the safety requirements.

In view of this, the electrical control box 200 further includes a metal cover plate 250 configured to cover the opening 580, and the metal cover plate 250 is configured for covering the inductor 230. The metal cover plate 250 may be made of sheet metal. Since the metal cover plate 250 has better fireproof and rust-proof performance, the inductor 230 can be prevented from being directly exposed to the external environment, and the inductor 230 can be protected.

In an embodiment, the box body 210 of the electric control box 200 and some of its components can be fixed as a whole through a plurality of connection members. The plurality of screw members include a first connection member, a second connection member and a third connection member, The first connection member is located at the upper end of the electric control box 200 (position P1 in FIG. 6), and passes through the outer metal box cover 500, the inner plastic box cover 600 and the inner plastic bottom plate 400 in sequence to connect the three. The second connection member penetrates the upper flange of the metal cover plate 250, the outer metal box cover 500, the inner plastic box cover 600 and the inner plastic bottom plate 400 in sequence from the accommodation groove 520 (position P2 in FIG. 6) to connect the fourth. The third connection member passes through the outer metal box cover 500, the inner plastic box cover 600 and the pre-positioning member 610 in sequence to connect the three (position P3 in FIG. 6).

As shown in FIG. 1 to FIG. 3, based on any of the above embodiments, the air conditioner 100 further includes a housing 120 mounted at the chassis 110. The housing 120 is formed with a separation groove 123 into which the shielding member located at the wall window extends. The housing 120 is divided into an indoor housing 121 and an outdoor housing 122 by the separation groove 123. The electric control box 200 is vertically installed on the outdoor housing 122. The electric control box 200 is located on the air intake side of the outdoor fan 160, so when the air conditioner 100 is working, the air flow driven by the outdoor fan 160 will pass around the electric control box 200, thereby taking away part of the heat generated by the electric control box 200.

After the air conditioner 100 is installed on the window of the wall, the outdoor housing 122 is located outdoors, and the indoor housing 121 is located indoors, which can prevent the noise generated by the outdoor components from propagating to the indoor and achieve the noise reduction effect. Then, the shielding member is pulled down to extend into the separation groove 123 of the air conditioner 100, the shielding member shields the gap between the two sides of the air conditioner 100 and the side wall of the window, thereby reducing the leakage of indoor cooling or heat from the space to the outdoors. It should be noted that the shielding member can be a window sash, or a window blind, or a curtain, etc. that shields light, or other protective window panels that can shield external objects from entering the room.

If the electric control box 200 is only fixed on the chassis 110 by the pre-positioning member 610 and the fixation structure at the bottom, and the top of the electric control box 200 is not fixed, then, during the process of transporting the air conditioner 100, the electric control box 200 may swing back and forth and collide with its adjacent components (such as the outdoor fan 160 or the fan bracket 180). As a result, the fire-proof or anti-rust coating on the surface of the electric control box 200 is scratched to fail, and there is a great potential safety hazard.

In an embodiment, in order to reduce the occurrence of the above situation, the top plate of the housing 120 is provided with the first fixation member 10 located above the electric control box 200, the top of the electric control box 200 is protruded with a first engagement member 11, and the first engagement member 11 and the first fixation member 10 are connected and fixed by a connection member.

The first fixation member 10 is formed on the top plate of the outdoor housing 122, the first fixation member 10 is provided with a through hole, and the first engagement member 11 is provided with a docking hole. The connection member passes through the through hole and the docking hole in sequence to connect and fix the electric control box 200 and the outdoor housing 122. The connection member can be a screw. The first engagement member 11 protrudes from the top surface of the electric control box 200, which can reduce water from entering the electric control box 200 via the docking hole of the first engagement member 11.

After the top of the electric control box 200 is connected to the first fixation member 10 of the outdoor housing 122 through the first engagement member 11, the position of the top of the electric control box 200 is fixed. That is, both the bottom and the top of the electric control box 200 are fixed, so that the electric control box 200 is not easy to swing, thereby reducing the occurrence of collision between the electric control box 200 and its adjacent components.

As shown in FIG. 1 to FIG. 3, in an embodiment, the fan bracket 180 is also configured in the housing 120, and the fan bracket 180 is configured for installing the outdoor fan 160. In the related art, the fan bracket 180 is usually only connected and fixed with the chassis 110 through the bottom thereof, during the process of transporting the air conditioner 100, the fan bracket 180 may also swing back and forth to collide with the electric control box 200, and scratch the fire-proof or anti-rust coating on the surface of the electric control box 200.

Therefore, the top plate of the housing 120 is provided with a second fixation member 20 and a third fixation member 30. The top surface of the fan bracket 180 is protrudingly provided with a second engagement member 21 and a third engagement member 31. The second engagement member 21 and the second fixation member 20, and the third engagement member 31 and the third fixation member 30 are connected and fixed by connection members.

The top plate of the outdoor housing 122 is provided with the second fixation member 20 and the third fixation member 30. The first fixation member 10, the second fixation member 20 and the third fixation member 30 form a triangle. After the first fixation member 10 is in abutment with the first engagement member 11, the second fixation member 20 is in abutment with the second engagement member 21, the third fixation member 30 is in abutment with the third engagement member 31, a triangular stable structure is formed, so that the installation positions of the outdoor housing 120, the electric control box 200 and the fan bracket 180 are stable and not easy to shake. Therefore, a certain distance is maintained between the electric control box 200 and the fan bracket 180 (as shown by D0 in FIG. 1), and the occurrence of collision between the two is reduced.

As shown in FIG. 11 and FIG. 13, during the process of fixing the top of the electric control box 200, after the connection member passes through the docking hole of the first engagement member 11, the inner end of the connection member protrudes into the interior of the electric control box 200. If the connection member and the docking hole are not tightly matched, water in the external environment may flow down the connection member and into the interior of the electrical control box 200, causing the electrical control components inside the electrical control box 200 to be damp.

In view of this, in order to avoid the above situation, the inner plastic box cover 600 of the electric control box 200 is provided with a groove 660 corresponding to the first engagement member 11, the backside of the inner plastic box cover 600 is provided with a drainage groove 670 extending downward from the groove 660 to the bottom thereof. After the connection member passes through the docking hole of the first engagement member 11, the inner end of the connection member is correspondingly located in the groove 660. Therefore, if there is water flowing down into the electric control box 200 along the connection member, the water will fall into the groove 660 from the inner end of the connection member, and then flow downward from the groove 660 along the drainage groove 670, and finally be discharged from the drainage gap at the bottom of the electric control box 200.

A plurality of support ribs 690 protrude from the top surface of the inner plastic box cover 600, and the plurality of support ribs 690 are supported on the top wall of the outer metal box cover 500, such that the top wall of the outer metal box cover 500 is not easily collapsed downward. A groove 660 is formed between two adjacent support ribs 690. One of the grooves 660 corresponds to the first engagement member 11, and one side of the remaining grooves 660 is open. The water in the external environment falls into the groove 660 on the top surface of the inner plastic box cover 600, and can flow from the opening on one side of the groove 660 to the back of the inner plastic box cover 600, so as to be discharged down along the back of the inner plastic box cover 600. In addition, the plurality of support ribs 690 can also play a role in strengthening the strength of the inner plastic box cover 600.

Figure 27:
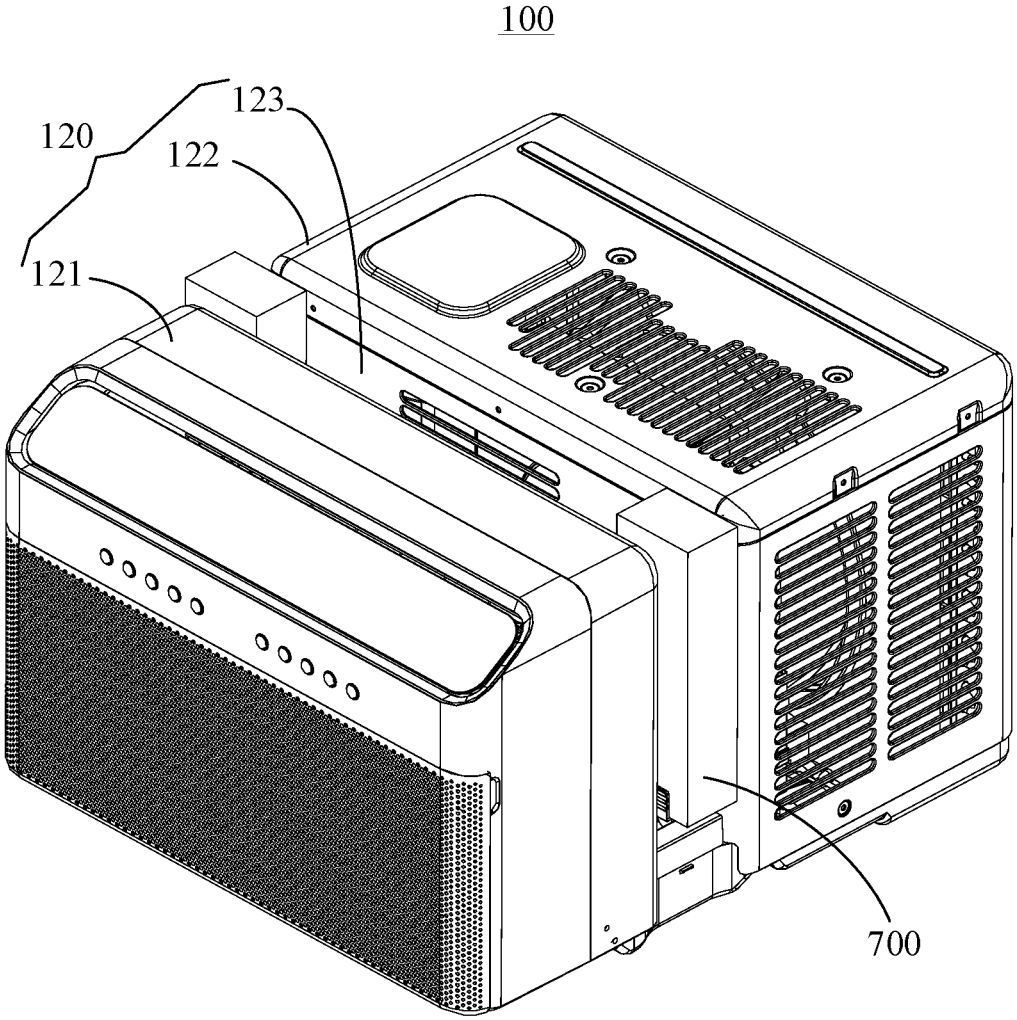
FIG. 27 is a schematic structural diagram of the air conditioner according to yet another embodiment of the present disclosure, with a sealing member in a storage state.
Figure 28:
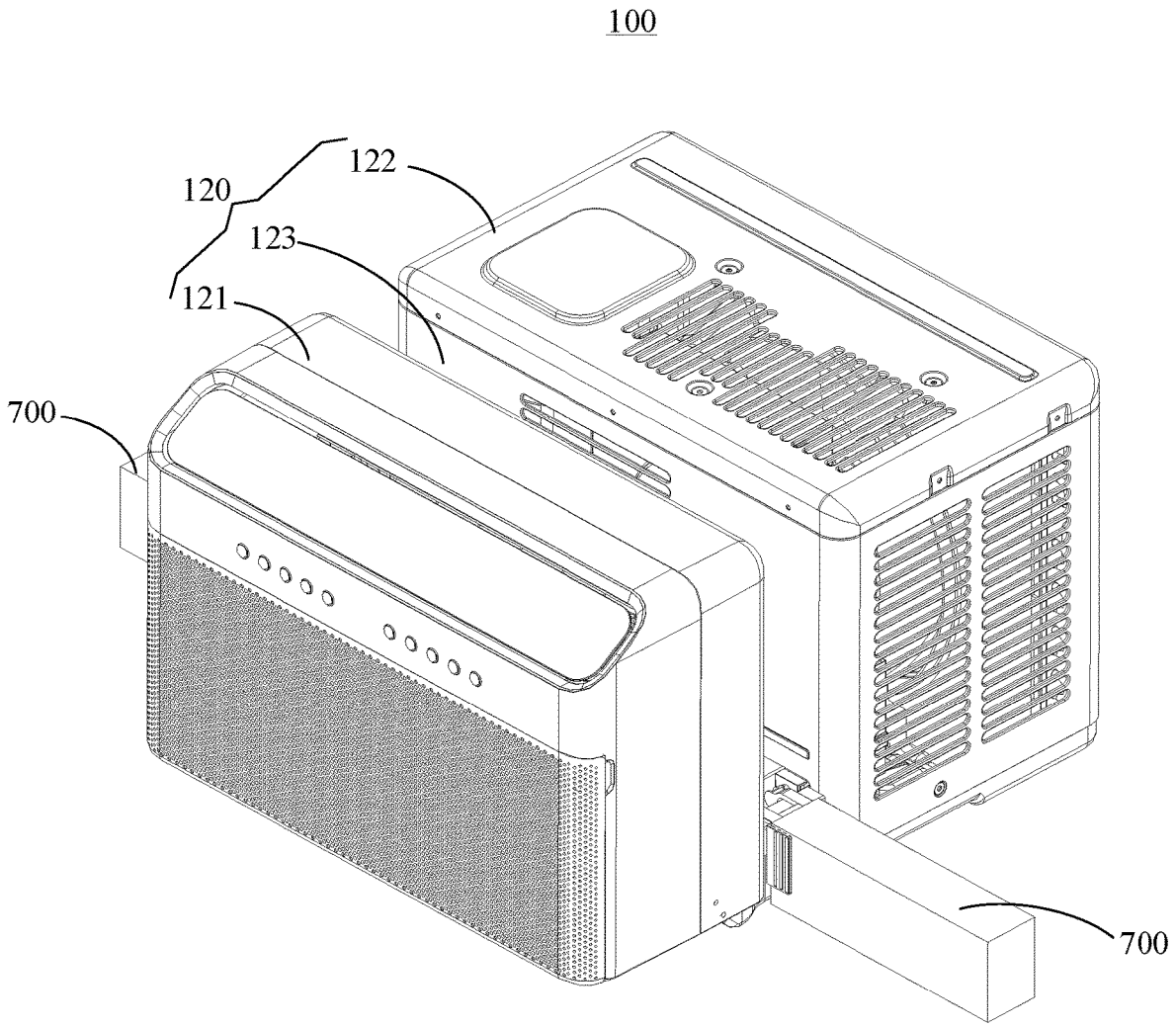
FIG. 28 is a schematic view of the sealing member of the air conditioner in FIG. 27 being switched to a working state.

As shown in FIG. 27 and FIG. 28, in an embodiment, the air conditioner 100 further includes a sealing member 700 movably installed on the separation groove 123, and the sealing member 700 is moved to switch between the storage state and the working state. In the storage state, the sealing member 700 is stored in the separation groove 123. In the working state, the sealing member 700 protrudes laterally from the separation groove 123, and is configured for the shielding member and/or the inner wall of the window to abut against.

After the air conditioner 100 is installed in the window, the sealing member 700 is moved to the working state, such that the sealing member 700 protrudes laterally from the separation groove 123 of the air conditioner 100, and the bottom surface of the sealing member 700 abuts against the bottom wall of the window. Then, the shielding member is pulled down to extend into the separation groove 123 of the air conditioner 100 until the lower edge of the shielding member comes into contact with the separation member and the sealing member 700, the sealing member 700 shields and seals the gap between the shielding member and the bottom wall of the window, so as to reduce the leakage of indoor cooling or heat from the gap to the outdoor. When the air conditioner 100 is not needed or transported, the sealing member 700 is moved to the storage state, which reduces the space occupied by the sealing member 700 and facilitates the storage or packaging of the air conditioner 100.

There are a number of ways in which the sealing member 700 can be movably installed. For example, the sealing member 700 is slidably installed in the separation groove; the sealing member 700 is rotatably installed in the separation groove 123. Specifically, the sealing member 700 is rotatably installed in the separation groove 123 to rotatably switch between the working state and the storage state.

As shown in FIG. 1 to FIG. 3, in another embodiment of the present disclosure, the air conditioner 100 includes a chassis 110 and an electric control box 200. The electric control box 200 is installed on the chassis 110 and is located in the outdoor housing 122. The bottom of the electric control box 200 is configured with a support structure abutting against the chassis 110, a plurality of heat dissipation channels are formed on the support structure, and the heat dissipation channels are used for air circulation.

The structure of the support structure is not specifically limited, as long as it can be formed with a heat dissipation channel. As shown in FIG. 6, the heat dissipation channel may be a through hole, a slit, or a long air channel, and can be designed according to the shape and structure of the support structure. The manner in which the support structure is constructed at the bottom of the electric control box 200 may be, but is not limited to that: the support structure is integrally formed with the box body 210 of the electric control box 200, or the support structure is a separately manufactured component, and then connected and fixed to the bottom of the electrical control box 200.

In technical solutions of the present disclosure, the support structure is provided at the bottom of the electric control box 200, so that the bottom of the electric control box 200 can be separated from the chassis 110, which helps the heat at the bottom of the electric control box 200 to dissipate outwards. Besides, a heat dissipation channel is also provided at the support structure, and the heat dissipation channel is used for air circulation, so that the heat generated by the electric control box 200 can be conducted to the support structure, and is taken away by air flow via convection of air through the heat dissipation channel on the support structure, so as to realize the heat dissipation of the electric control box 200 and improve the heat dissipation efficiency of the electric control box 200.

As shown in FIG. 6, the position of the support structure is not limited here. It may be located at both ends of the bottom of the electric control box 200, or at the middle position of the bottom of the electric control box 200, or at the bottom of the electric control box 200. In this embodiment, the electric control box 200 includes a box body 210, and one end of the bottom of the box body 210 is provided with a notch. The support structure is provided at one end of the box body 210 away from the notch.

The top wall or side wall of the notch is provided with a wire hole. One end of the wire of the electric control box 200 penetrates into the inside of the box body 210 through the wire hole to connect with the electric control board 220 inside the electric control box 200. The other end of the wire is connected to an electrical control component of the air conditioner 100 (e.g., a display panel, or an outdoor temperature sensor, or an indoor temperature sensor, or a discharge or return air temperature sensor of a compressor, etc.). Constructing the support structure at the end of the box body 210 away from the notch can reduce the interference of the support structure with the wire body at the notch position, and prevent the wire body from threading at the notch position.

As shown in FIG. 6 and FIG. 12, the box body 210 includes a bottom plate 211 and a box cover 212 adapted to cover the bottom plate 211. Therefore, the support structure may be provided at the lower end of the bottom plate 211; or, the support structure may be provided at the lower end of the box cover 212.

The bottom plate 211 is suitable for the installation of electric control element of the electric control box 200, and the electric control element can be the electric control board 220, the inductor 230, the heat sink 240, and the like. During the assembling process, the electronic control element is firstly fixed on the bottom plate 211, then the box cover 212 is covered on the bottom plate 211, and finally the box cover 212 and the bottom plate 211 are connected and fixed. The support structure may be provided at the lower end of the bottom plate 211, or the support structure may be provided at the lower end of the box cover 212. Alternatively, the support structure is provided at both the lower end of the bottom plate 211 and the lower end of the box cover 212.

For the box body 210 of the electric control box 200, the box body 210 should comply with the national safety standards, one of which is that the box body 210 should have a fireproof function. In the related art, the box body 210 is usually only made of metal material, but this makes the box body 210 relatively bulky and expensive.

As shown in FIG. 6 and FIG. 12, in order to solve the above technical problem, the bottom plate 211 includes an outer metal bottom plate 300 and an inner plastic bottom plate 400, and the box cover 212 includes an outer metal cover 500 and an inner plastic cover 600. That is to say, the box body 210 of the electric control box 200 actually has an inner layer part and an outer layer part. The inner layer part is composed of the inner plastic bottom plate 400 and the inner plastic box body 210, and the outer layer part is composed of the outer metal bottom plate 300 and the outer metal box body 210. The outer layer part is made of rust-proof sheet metal parts, or a metal layer is sprayed on the surface thereof, so as to make the box body 210 of the electric control box 200 safe and reliable.

As shown in FIG. 6, FIG. 12 and FIG. 15, in an embodiment, the support structure includes a first support member 630 provided at the lower end of the inner plastic box cover 600; and/or the support structure includes a second support member 440 provided at the lower end of the inner plastic bottom plate 400. That is, the support structure is provided at the inner layer portion of the box body 210. This design is mainly based on two considerations: on the one hand, the inner layer part directly receives the heat emitted by the electronic control elements inside the electronic control box 200, the inner layer part can directly conduct heat to the support structure without heat transfer through the housing 120, and the heat dissipation is fast; on the other hand, all the inner layer parts are made of plastic, so the cost is low and it is convenient for the support structure to be integrally formed with the inner plastic bottom plate 400 or the inner plastic box cover 600.

Figure 8:
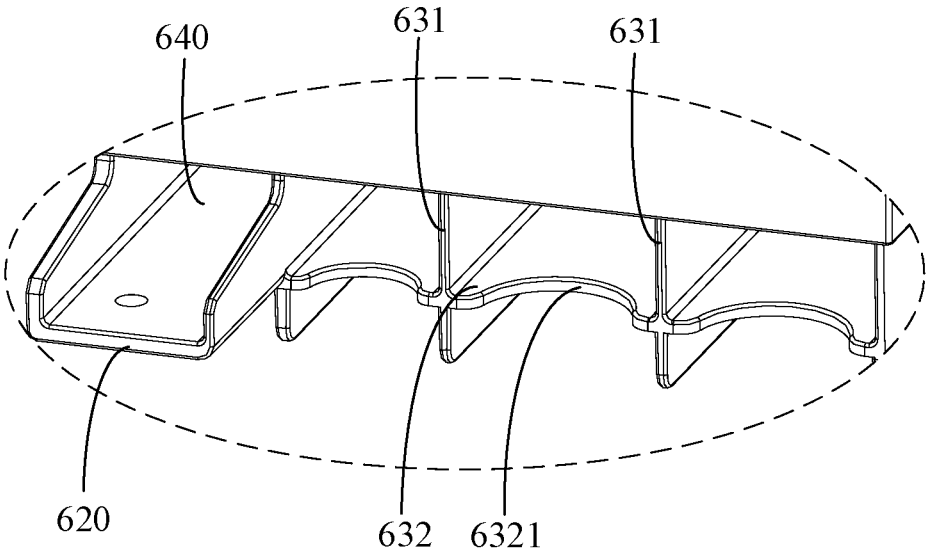
FIG. 8 is an enlarged view of portion E in FIG. 6.

As shown in FIG. 6, FIG. 8 and FIG. 16, the first support member 630 includes a plurality of support plates 631. The plurality of support plates 631 are spaced apart along the length direction of the electrical control box 200 to form the heat dissipation channel at intervals between two adjacent support plates 631.

The two opposite sides of the support plate 631 form heat dissipation surfaces, so that the support structure has a larger heat dissipation area. When the airflow passes through the heat dissipation channel, the airflow takes away the heat conducted by the electric control box 200 to the heat dissipation surface of the support plate 631, and the heat dissipation effect is better.

Further, the first support member 630 further includes a horizontal partition plate 632 connecting two adjacent support plates 631, and the horizontal partition plate 632 divides the heat dissipation channel into an upper sub-channel and a lower sub-channel. The first support member 630 connects two adjacent support plates 631 through the horizontal partition plate 632, which can enhance the strength of the first support member 630. In addition, the upper and lower sides of the horizontal partition plate 632 are formed with heat dissipation surfaces, which increases the overall heat dissipation area of the first support member 630. When the airflow passes through the upper sub-channel and the lower sub-channel, the airflow takes away the heat on the heat dissipation surface of the horizontal partition plate 632, which greatly improves the heat dissipation effect.

As shown in FIG. 6, FIG. 12 and FIG. 15, a notch groove 6321 is defined on the side edge of the horizontal partition plate 632 away from the vertical partition plate 633. The existence of the notch grooves 6321 can reduce the resistance of the horizontal partition plate 632 to the flow of air flow, which is favorable for the external airflow to pass through the upper sub-channel and the lower sub-channel.

Figure 9:
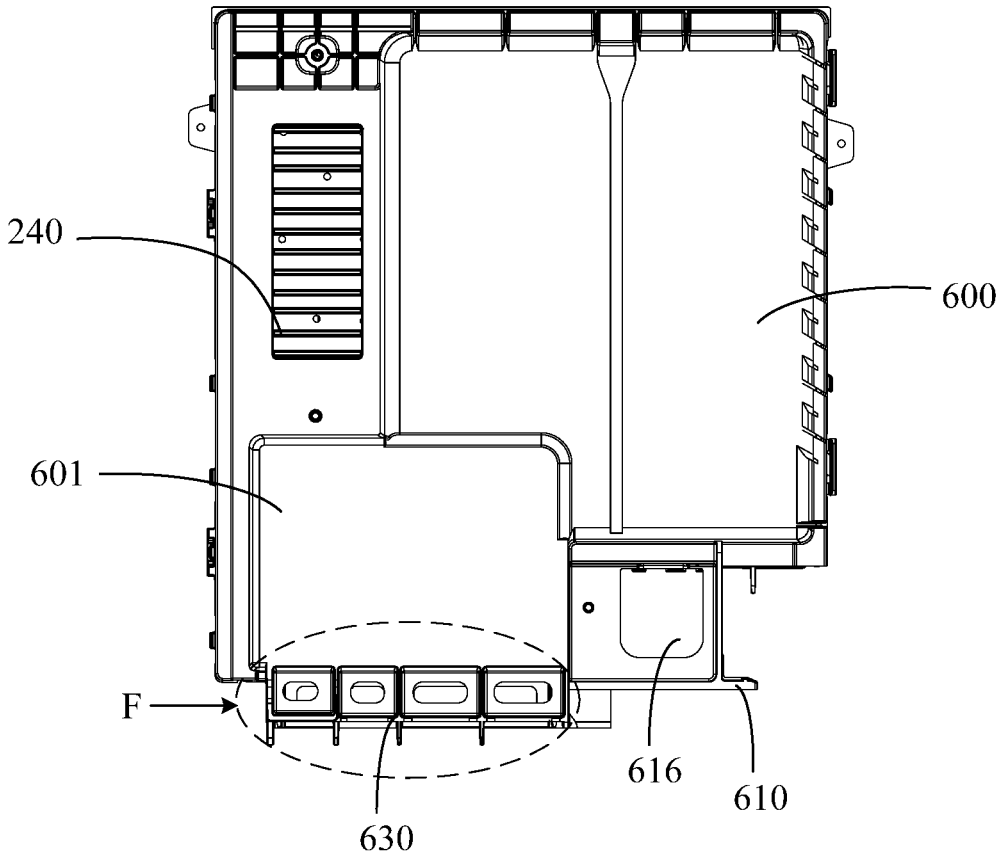
FIG. 9 is a rear view of an inner plastic box cover inside the electric control box in FIG. 6.
Figure 10:
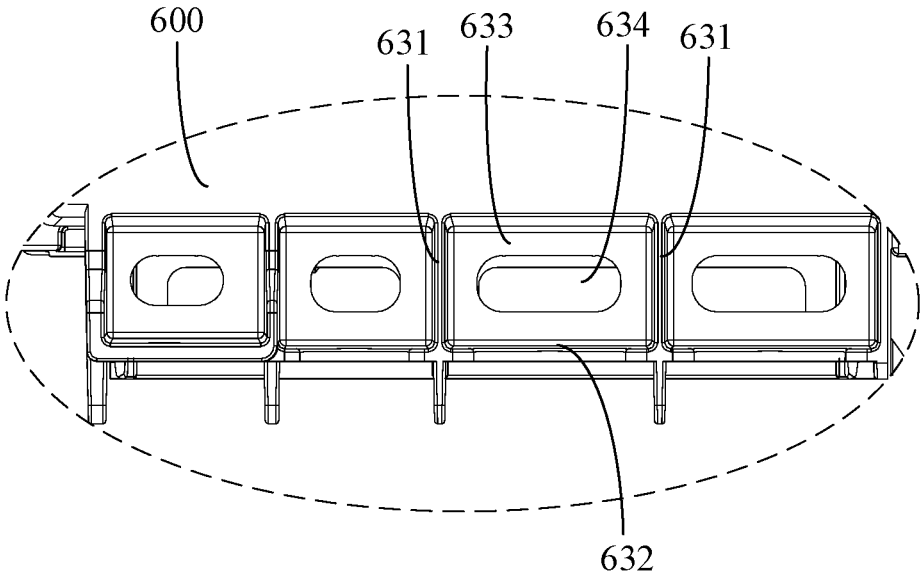
FIG. 10 is an enlarged view of portion F in FIG. 9.

As shown in FIG. 9 and FIG. 10, the first support member 630 further includes a vertical partition plate 633 disposed at the ventilation surface of the upper sub-channel. The vertical partition plate 633 is provided with a ventilation hole 634 communicating with the upper sub-channel.

The opposite side edges of the vertical partition plate 633 are respectively connected to the two adjacent support plates 631, the lower edge of the vertical partition plate 633 is connected to the horizontal partition plate 632, and the upper edge of the vertical partition plate 633 is connected to the bottom wall of the box body 210. The vertical partition plate 633 connects the box body 210, at least two support plates 631 and the horizontal partition plate 632 into a whole, so as to improve the strength of the support structure. The vertical partition plate 633 blocks the flow of the airflow in the upper sub-channel, so the vertical partition plate 633 is provided with a ventilation hole 634 communicating with the upper sub-channel.

The second support member 440 extends along the length direction of the electric control box 200, the second support member 440 penetrates through a strip-shaped through hole 441 extending along the length direction thereof, and the strip-shaped through hole 441 forms the heat dissipation channel.

The second support member 440 supports the electric control box 200 along the length direction of the electric control box 200, so that the electric control box 200 is installed stably and is not easily toppled. The number of strip-shaped through holes 441 on the second support member 440 is multiple, and the plurality of strip-shaped through holes 441 are spaced apart along the length direction of the second support member 440. The plurality of strip-shaped through holes 441 can not only improve the heat dissipation effect of the support structure, but also reduce the weight of the inner plastic bottom plate 400, thereby reducing the overall weight of the electrical control box 200.

As shown in FIG. 3 and FIG. 9, based on any of the above embodiments, in order to facilitate the installation of the electrical control box 200, a pre-positioning member 610 is further provided at the bottom of the box body 210 on one side of the notch, and the pre-positioning member 610 is suitable for being inserted and positioned with the chassis 110. An end of the box body 210 away from the notch is further provided with a fixation foot 620, and the fixation foot 620 is suitable for being connected and fixed with the chassis 110.

Both the pre-positioning member 610 and the fixation foot 620 are provided at the lower end of the inner plastic box cover 600. When installing the electric control box 200, the pre-positioning member 610 of the electric control box 200 is inserted and positioned with the chassis 110, and then the fixation foot 620 of the electric control box 200 are connected to the chassis 110 by using a connection member. The connection member can be a screw. In order to enhance the heat dissipation of the inner plastic box cover 600, a through hole 616 can be formed in the pre-positioning member 610, and a heat dissipation channel is formed in the through hole 616. The fixation foot 620 may also be configured with heat dissipation channels, so that the number of heat dissipation channels can be increased or decreased, thereby increasing the heat dissipation efficiency.

As shown in FIG. 15 and FIG. 16, based on any one of the above embodiments, the electric control box 200 further includes an electric control board 220 and an inductor 230, and the electric control board 220 and the inductor 230 are installed on the bottom plate 211 in an up-down direction. The inner plastic box cover 600 is provided with a main cavity 601 and an auxiliary cavity 602 corresponding to one end of the main cavity 601 below. The main cavity 601 is suitable for accommodating components on the electric control board 220, and the auxiliary cavity 602 is suitable for accommodating the inductor 230. The electrical control box 200 further includes a heat sink 240 mounted at the electrical control board 220, and the heat sink 240 extends outward from the box cover 212.

As described above, the bottom plate 211 includes an outer metal bottom plate 300 and an inner plastic bottom plate 400. The weight of the electric control board 220 is relatively small, such that the electric control board 220 can be installed on the inner plastic bottom plate 400. Components with higher heights such as capacitors are installed on the electric control board 220, and such components will extend from the electric control board 220 into the main cavity 601 of the inner plastic box cover 600. Considering the heavy weight of the inductor itself, the inductor 230 is fixed to the outer metal bottom plate 300 through the inner plastic bottom plate 400. After the inductor 230 is installed, the inductor 230 extends from the outer metal bottom plate 300 into the auxiliary cavity 602 of the inner plastic box cover 600.

Based on any one of the above embodiments, the air conditioner 100 further includes a housing 120 mounted at the chassis 110, the housing 120 is formed with a partition groove 123, and the housing 120 is divided into an indoor housing 121 and an outdoor housing 122 by the partition groove 123. After the air conditioner 100 is installed on the window of the wall, the outdoor housing 122 is located outdoors, and the indoor housing 121 is located indoors, which can prevent the noise generated by the outdoor components from propagating to the indoor, and achieve a noise reduction effect. Then, the shielding member is pulled down to extend into the separation groove 123 of the air conditioner 100, and the shielding member blocks the gap between the two sides of the air conditioner 100 and the side wall of the window, Therefore, the leakage of indoor cooling or heat from the space to the outdoors can be reduced. It should be noted that the shielding member can be a window sash, or a window blind, or a curtain, etc. that shields light, or other protective window panels that can shield external objects from entering the room.

In an embodiment, considering that when the air conditioner 100 is working, the indoor fan 150 drives the indoor air into the indoor housing 121 to exchange heat with the indoor heat exchanger 130, blows the heat-exchanged air out from the indoor housing 121 to the indoor environment, so as to achieve cooling and heating of the indoor environment. At the same time, the outdoor fan 160 drives the outdoor air into the outdoor housing 122 to exchange heat with the outdoor heat exchanger 140, and blows the heat-exchanged air out of the outdoor housing 122 to the outdoor environment. Therefore, the electric control box 200 is set to correspond to the air intake side of the outdoor fan 160. Therefore, when the air conditioner 100 is in operation, the airflow driven by the outdoor fan 160 will pass around the electric control box 200, thereby taking away part of the heat generated by the electric control box 200. In order to improve the heat dissipation efficiency of the electric control box 200, a support structure is also provided at the bottom of the electric control box 200, and the electric control box 200 is supported on the chassis 110 through the support structure. In this way, the bottom of the electric control box 200 can be spaced apart from the chassis 110, which helps the heat at the bottom of the electric control box 200 to dissipate to the outside.

As shown in FIG. 1 and FIG. 3, the present disclosure provides an embodiment of an electric control box 200. The electrical control box 200 is suitable for being installed in electrical equipment as an electrical control device. For example, the electrical control box 200 may be applied to an air conditioner or other home appliances. The air conditioner may be a window air conditioner 100 or a split-type air conditioner. For the window air conditioner 100, the electric control box 200 may be installed in the indoor housing of the window air conditioner 100, or may be installed in the outdoor housing of the window air conditioner 100. For the split-type air conditioner, the electric control box 200 may be installed in an indoor unit or an outdoor unit. In the following embodiments, the application of the electric control box 200 to the window air conditioner 100 is mainly used as an example for introduction.

As shown in FIG. 11, FIG. 12 and FIG. 15, the present disclosure provides another embodiment of the electric control box 200. The electrical control box 200 includes a box body 210 and an inductor 230. The box body 210 includes a bottom plate 211 and a box cover 212 adapted to cover the bottom plate 211. The inductor 230 is provided at the bottom plate 211 and extends into the box cover 212. The bottom plate 211 includes an outer metal bottom plate 300 and an inner plastic bottom plate 400. A part of the inner plastic bottom plate 400 is hollowed out to form an installation opening 430, and the inductor 230 passes through the installation opening 430 and is fixed on the outer metal bottom plate 300.

The bottom plate 211 includes an outer metal bottom plate 300 and an inner plastic bottom plate 400, and the box cover 212 includes an outer metal box cover 500 and an inner plastic box cover 600. That is to say, the box body 210 of the electric control box 200 actually has an inner layer part and an outer layer part. The inner layer part is composed of the inner plastic bottom plate 400 and the inner plastic box cover 600, and the outer layer part is composed of the outer metal bottom plate 300 and the outer metal box cover 500. The outer part is made of rust-proof sheet metal parts, so that the box body 210 of the electric control box 200 has the function of fire prevention and rust prevention, and the installation performance thereof is improved.

Since the outer metal bottom plate 300 is made of sheet metal parts, so compared with the inner plastic bottom plate 400, the outer metal bottom plate 300 has higher strength and is not easily deformed. Therefore, the inductor 230 is passed through the installation opening 430 of the inner plastic bottom plate 400 to be fixed on the outer metal bottom plate 300, such that the weight of the inductor 230 is applied to the outer metal bottom plate 300, and the outer metal bottom plate 300 can strongly support the inductor 230 and is not easily deformed.

In technical solutions of the present disclosure, the bottom plate 211 of the electric control box 200 is designed to include an outer metal bottom plate 300 and an inner plastic bottom plate 400, and a part of the inner plastic bottom plate 400 is hollowed out to form an installation opening 430. Further, the inductor 230 is passed through the installation opening 430 and fixed on the outer metal bottom plate 300, the outer metal bottom plate 300 is used to strongly support the inductor 230, so as to prevent the inductor 230 from bending and deforming the box body 210, and to ensure the stability of the installation of the inductor 230. In addition, compared with the inner plastic bottom plate 400, the heat transfer efficiency of the outer metal bottom plate 300 is higher. Therefore, the heat generated by the inductor 230 during operation is directly conducted to the outer metal bottom plate 300. Then, the heat is quickly dissipated to the external environment through the outer metal bottom plate 300 to prevent the heat from accumulating inside the box body 210 and improve the heat dissipation efficiency.

Figure 18:
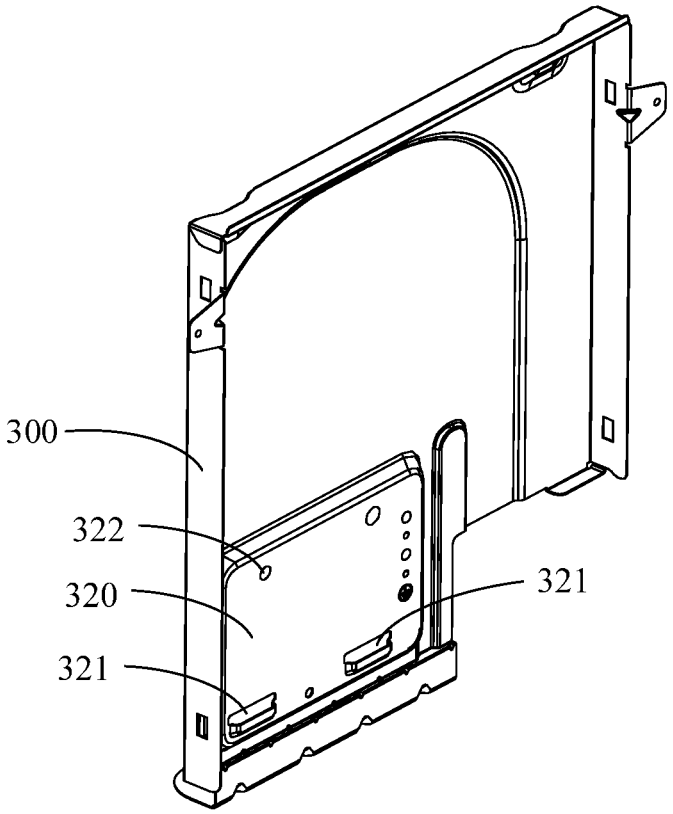
FIG. 18 is a structural diagram of an outer metal bottom plate in FIG. 12.

As shown in FIG. 12, FIG. 15 and FIG. 18, in an embodiment, in order to enhance the installation stability of the inductor 230, an installation platform 320 protrudes from the outer metal bottom plate 300 toward the installation opening 430, and the inductor 230 is fixed on the installation platform 320. The installation platform 320 may be directly formed by thickening the inner surface of the outer metal bottom plate 300; or the outer metal bottom plate 300 may be recessed from the outside to the inside, and the installation platform 320 may be formed on the inner side of the recessed position. The former formation method is to achieve structural enhancement by increasing the thickness; and the latter formation method is to increase the compressive strength by causing plastic deformation on the outer metal bottom plate 300, thereby enhancing its strength. Specifically, the installation platform 320 adopts the latter forming method described above.

Figure 19:
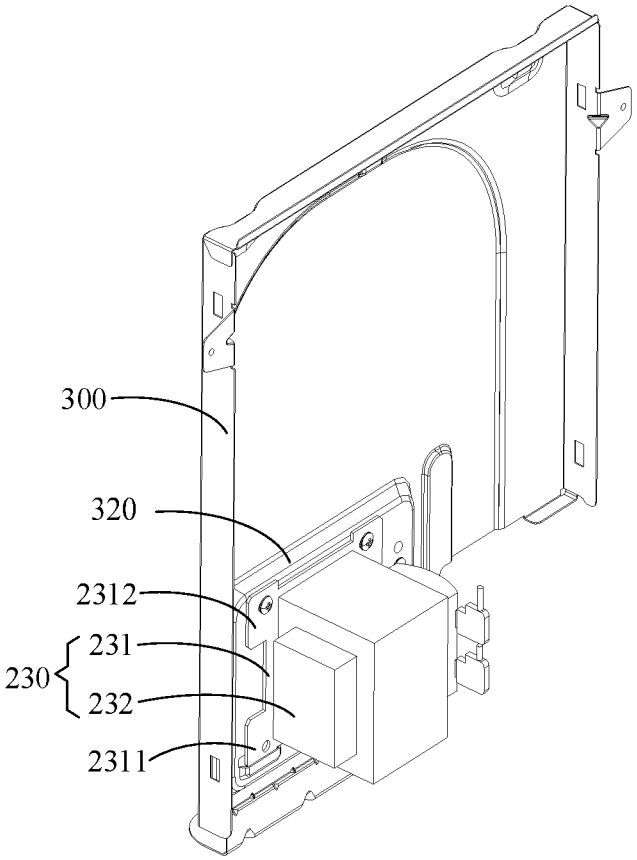
FIG. 19 is a schematic view of the assembly of the outer metal bottom plate and an inductor in FIG. 18.
Figure 20:
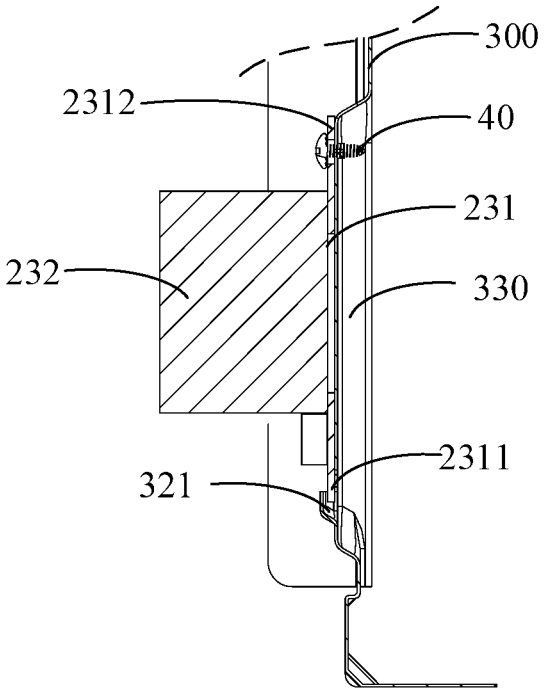
FIG. 20 is a structural cross-sectional view after the outer metal bottom plate and the inductor are assembled in FIG. 19.

As shown in FIG. 18 to FIG. 20, in an embodiment, the inductor 230 includes a base plate 231 and an inductor body 232 provided at the base plate 231. In order to facilitate the fixing of the inductor 230 to the installation platform 320, an insertion member 2311 is formed on the lower end of the base plate 231. The installation platform 320 is provided with a slot 321 corresponding to the insertion member 2311, and the slot 321 is inserted and connected to the insertion member 2311 correspondingly. After the insertion member 2311 is inserted in the slot 321 and positioned, the inductor 230 is not easy to move, and then the inductor 230 is connected and fixed to the installation platform 320 to reduce the difficulty of installing the inductor 230.

Further, a lug 2312 is formed on the upper end of the base plate 231, and the lug 2312 is provided with a through hole. The installation platform 320 is provided with a docking hole 321 corresponding to the through hole, and the inductor 230 is connected and fixed by using a connection member to pass through the through hole and the docking hole 321 in sequence. The connection member may be a screw.

As shown in FIG. 18 to FIG. 20, during the above-mentioned assembling process of installing the inductor 230, the connection member will pass out from the outer metal bottom plate 300 to the outside of the box body 210. If the outer end of the connection member protrudes from the outer wall of the box body 210, the operator may easily touch or be scratched by the outer end of the connection member during installation or maintenance of the electrical control box 200. Alternatively, the outer end of the connection member contacts the housing of the product to which the electric control box 200 is applied, which is likely to scratch the housing of the applied product.

In view of this, in order to avoid the above situation, the outer metal bottom plate 300 is partially recessed from the outer wall surface thereof to the inner wall surface thereof, an installation platform 320 is formed inside the recessed position, and a sink groove 330 is formed outside the recessed position, and the sink groove 330 is suitable for accommodating the connection member 40 of the inductor 230. That is to say, after the connection member 40 of the fixed inductor 230 passes through the installation platform 320, the outer end of the connection member 40 is accommodated in the sink groove 330 and will not protrude from the outer wall surface of the box body 210, so that it is not easy to scratch the operator or the housing of the product.

Besides, the electric control board 220 needs to be grounded through a grounding member, and the grounding member 50 (e.g., a grounding screw) can be installed on the outer metal base plate 300 to be grounded through the outer metal bottom plate 300. Similarly, in order to prevent the outer end of the grounding member from scratching the operator or the housing of the product, the grounding member is also installed on the installation platform 320. The sink groove 330 is also suitable for accommodating the grounding member 50.

Figure 24:
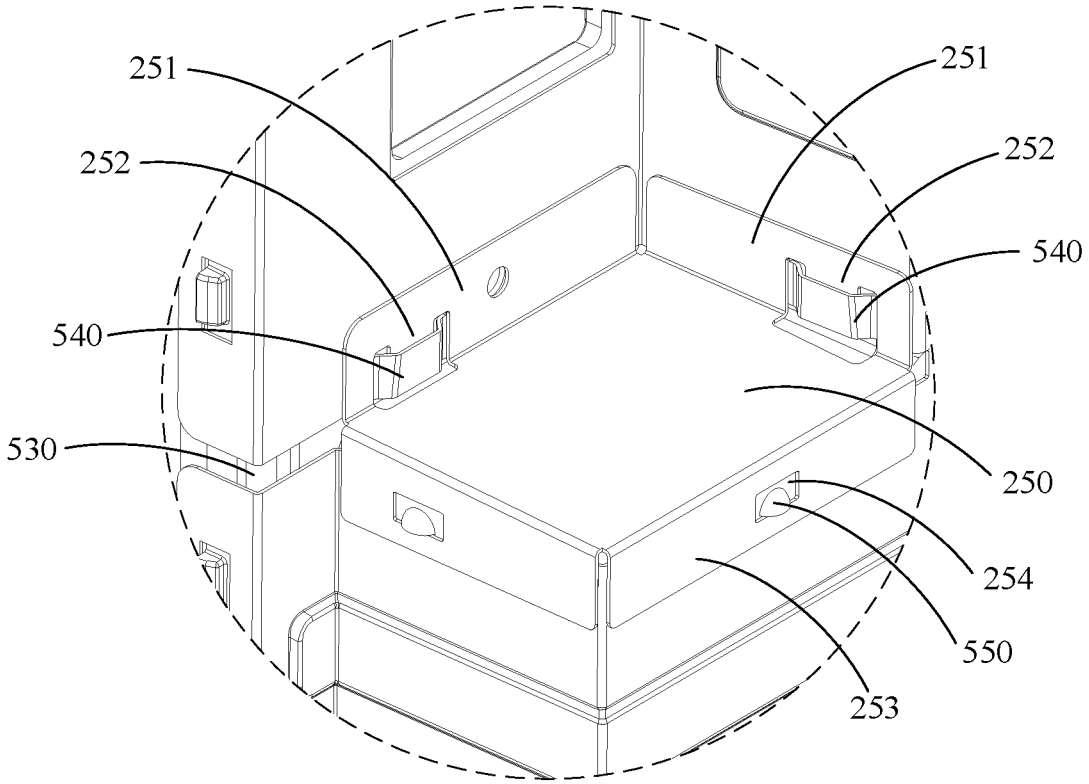
FIG. 24 is an enlarged view of portion Gin FIG. 23.

As shown in FIG. 15, FIG. 16 and FIG. 24, based on any one of the above embodiments, the electric control box 200 further includes an electric control board 220, and the electric control board 220 is installed on the bottom plate 211 and located above the inductor 230. The box cover 212 is formed with a main cavity 601 and an auxiliary cavity 602. The main cavity 601 is suitable for correspondingly accommodating components on the electric control board 220, and the auxiliary cavity 602 is suitable for correspondingly accommodating the inductor 230.

The electronic control board 220 is installed on the inner plastic bottom plate 400 of the bottom plate 211. The position of the inner plastic bottom plate 400 corresponding to the electric control board 220 is hollow. A grid bracket 420 is formed at the hollowed-out position 410 (as shown in FIG. 12). The grid bracket 420 separates the electric control board 220 from the outer metal bottom plate 300, so that the electric control board 220 does not contact with the outer metal bottom plate 300. The bottom surface of the electric control board 220 can directly transfer heat to the outer metal bottom plate 300 without passing through the inner plastic bottom plate 400.

The electric control box 200 further includes a heat sink 240, and the heat sink 240 is installed on one end of the electric control board 220 and is correspondingly located above the inductor 230. An accommodation groove 520 is formed on the outer wall surface of the box cover 212 at the position of the heat sink 240. The groove wall of the accommodation groove 520 defines an extension opening 510 for the heat sink 240 to extend to the accommodation groove 520. After the heat sink 240 is installed, the heat sink 240 protrudes from the inside of the box body 210 into the accommodation groove 520 through the extension opening 510, such that the heat sink 240 does not protrude from the outside of the electrical control box 200, and the heat sink 240 is exposed outside the electrical control box 200, which can effectively dissipate the heat generated by the electrical control board 220 to the outside of the box body 210.

As shown in FIG. 24 and FIG. 23, during the process of manufacturing the box body 210, due to the difficulty of mold manufacturing, it is not easy to form a groove wall in the auxiliary cavity 602 at a position corresponding to the accommodation groove 520, but an opening 580 is formed at this position. If the opening 580 is directly opened, part of the inner plastic box cover 400 will be exposed to the external environment from the opening 580, which does not meet the safety requirements.

In view of this, the electrical control box 200 further includes a metal cover plate 250 configured to cover the opening 580, and the metal cover plate 250 is suitable for covering the inductor 230. The metal cover plate 250 may be made of sheet metal. Since the metal cover plate 250 has better fireproof and rust-proof performance, the inductor 230 can be prevented from being directly exposed to the external environment, and the inductor 230 can be protected.

Besides, the outer metal box cover 500 of the box cover 212 is provided with an extension opening 510, and the inner plastic box cover 600 is also provided with an extension opening 650. The extension opening 650 of the inner plastic box cover 600 should coincide with the extension opening 510 of the outer metal box cover 500. However, during the manufacturing and molding process, due to the possibility of manufacturing errors, the extension opening 510 of the outer metal box cover 500 may not correspond to the extension opening 650 of the inner plastic box cover 600, that is, the positions of the two are slightly deviated. It is difficult for the heat sink 240 to protrude through the extension opening 650 of the inner plastic box cover 600 and the extension opening 510 of the outer metal box cover 500 in sequence, and then the production mold of the box cover 212 needs to be readjusted, which will lead to low production efficiency.

Figure 25:
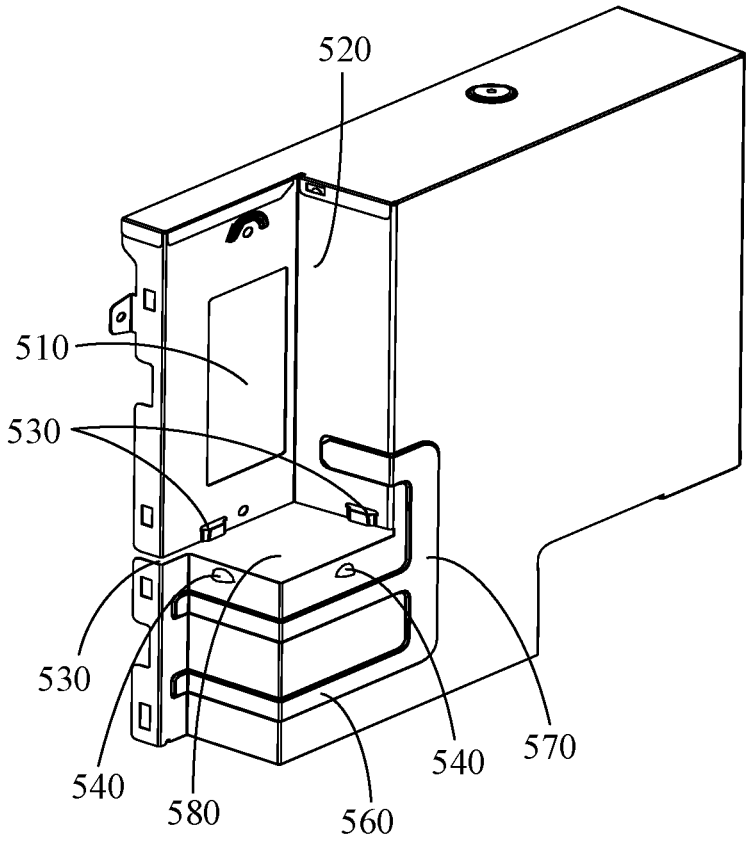
FIG. 25 is a schematic structural diagram of the outer plastic box cover in FIG. 12.
Figure 26:
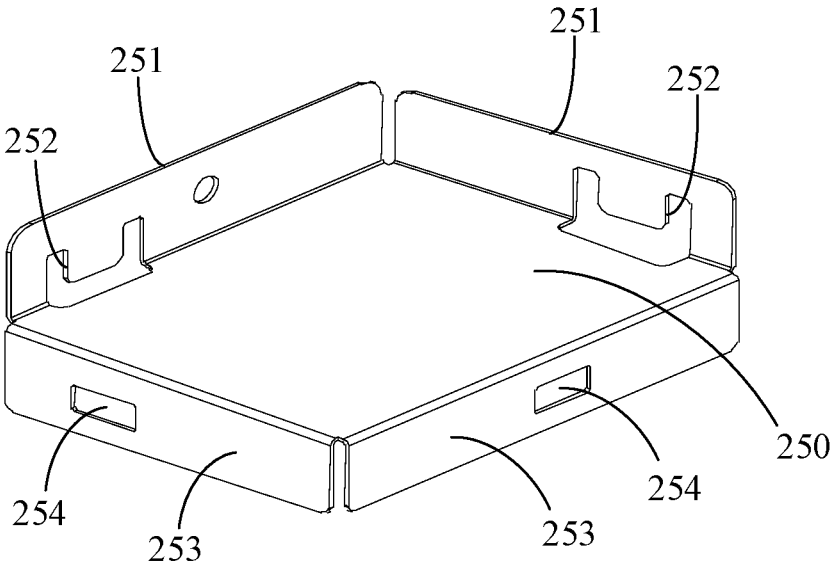
FIG. 26 is a schematic structural diagram of the metal cover plate in FIG. 12.

As shown in FIG. 24 and FIG. 25, in an embodiment, the outer metal box cover 500 is provided with a slit 530 extending from its side wall to the upper edge of the opening. The slit 530 is suitable for adjusting the position of the extension opening 510 to fit the heat sink 240.

The slit 530 can make the position of the extension opening 510 of the outer metal box cover 500 finely adjusted up and down, such that the extension opening 510 of the outer metal box cover 500 corresponds to the extension opening 650 of the inner plastic box cover 600, and is further aligned with the heat sink 240.

However, the existence of the above-mentioned slit 530 will reduce the strength of the outer metal box cover 500, so that the outer metal box cover 500 may be torn at the position of the slit 530. To avoid this situation, after installing the heat sink 240, parts of the outer metal box cover 500 on both sides of the slit 530 can be connected and fixed by the metal cover plate 250, so that the outer metal box cover 500 is not easily torn from the position of the slit 530.

As shown in FIG. 23 to FIG. 26, the metal cover plate 250 is connected to the outer metal box cover 500. In an embodiment, the metal cover plate 250 has two adjacent upper flanges 251 that are folded upward, and the upper flanges 251 are provided with through holes. The upper edge of the through hole extends downward with a plug-in piece 252. The box body 210 is provided with a buckle 540 facing the upward opening 580 at a position on the upper side of the slit 530. The buckle 540 is suitable for inserting the plug-in piece 252 into it from top to bottom.

Further, the metal cover plate 250 also has two adjacent lower flanges 253 that are folded downwards. The lower flanges 253 are fastened to the outer wall of the auxiliary cavity 602. One of the lower flange 253 and the outer wall surface of the auxiliary cavity 602 is provided with a buckle 540, and the other is provided with a buckle hole 254 corresponding to the buckle 540.

When installing the metal cover plate 250, first it is possible to cover the metal cover plate 250 to the opening 580 of the auxiliary cavity 602 of the box body 210 from top to bottom.

During this process, the plug-in pieces 252 of the metal cover plate 250 are aligned and inserted into the buckles 540 of the box body 210 to realize the insertion and positioning of the metal cover plate 250, until the lower flange 253 of the metal cover plate 250 is buckled on the outer wall surface of the auxiliary cavity 602. Then, the lower flange 253 and the outer wall surface of the auxiliary cavity 602 are correspondingly buckled through the buckle 540 and the buckle hole 254, so as to connect and fix the two.

As shown in FIG. 24, in an embodiment, in order to prevent the outer metal box cover 500 from being torn at the position of the slit 530, a first rib 560 can also protrude on the outer wall surface of the main cavity 601, and the first rib 560 extends up and down. A plurality of second ribs 570 protrude from the outer wall surface of the auxiliary cavity 602. The plurality of second ribs 570 extend from a side wall of the auxiliary cavity 602 to the outer wall surface of the main cavity 601 through another adjacent side wall thereof, and are connected to the first ribs 560.

The first rib 560 and the plurality of second rib 570 are arranged in a substantially E-shape. In this way, the strength of the parts of the outer metal box cover 500 located on the upper and lower sides of the slit 530 can be strengthened, and the bending deformation resistance thereof can be improved, thereby making it difficult to tear from the slit 530.

The above are only some embodiments of the present disclosure, and do not limit the scope of the present disclosure thereto. Under the inventive concept of the present disclosure, equivalent structural transformations made according to the description and drawings of the present disclosure, or direct/indirect application in other related technical fields are included in the scope of the present disclosure.

What is claimed is:

1. An air conditioner comprising:

a chassis including a socket;

a housing mounted at the chassis and including an indoor housing and an outdoor housing, an indoor heat exchanger and an indoor fan being installed in the indoor housing, and an outdoor heat exchanger and an outdoor fan being installed in the outdoor housing; and an electric control box vertically installed on the outdoor housing and including a pre-positioning member and a fixation structure provided at a bottom of the electric control box, the pre-positioning member corresponding to the socket, the electric control box being located on an air intake side of the outdoor fan and arranged side by side with a compressor;

wherein:

the pre-positioning member is configured to be inserted in the socket of the chassis to position the electric control box; and the fixation structure is configured to connect and fix the electric control box to the chassis.

2. The air conditioner of claim 1, wherein:

the electric control box includes a box body;

the box body includes a bottom plate and a box cover configured to cover the bottom plate;

the bottom plate includes an outer metal bottom plate and an inner plastic bottom plate;

the box cover includes an outer metal box cover and an inner plastic box cover; and the pre-positioning member is provided at the inner plastic bottom plate or on the inner plastic box cover.

3. The air conditioner of claim 2, wherein:

the fixation structure includes a fixation plate provided at the outer metal box cover and a fixation foot provided at the inner plastic bottom plate and opposite to the fixation foot; and the fixation plate and the fixation foot are connected and fixed to the chassis.

4. The air conditioner of claim 2, wherein:
the electric control box further includes an electric control board mounted at the inner plastic bottom plate;
the inner plastic bottom plate is hollowed out at a position corresponding to the electric control board; and
a grid bracket is formed at the hollowed position and separates the electric control board and the outer metal bottom plate.

5. The air conditioner of claim 4, wherein:
the inner plastic box cover is provided with a plurality of heat dissipation holes on a side wall corresponding to a main cavity, and the plurality of heat dissipation holes are spaced apart along an up-down direction; and
one heat dissipation hole of the heat dissipation holes is provided with at least one of:
an upper water baffle protruding from an upper edge of the one heat dissipation hole; or
a lower water baffle protruding from a lower edge of the one heat dissipation hole.

6. The air conditioner of claim 2, wherein:
the electric control box further includes an inductor provided at the bottom plate and extending into the box cover;
the inner plastic bottom plate of the bottom plate is partially hollowed out to form an installation passage; and
the inductor passes through the installation passage and is fixed on the outer metal bottom plate.

7. The air conditioner of claim 6, wherein:
the outer metal bottom plate is partially recessed from an outer wall surface of the outer metal bottom plate toward an inner wall surface of the outer metal bottom plate to form:
an installation platform at an inner side of a recessed position where the outer metal bottom plate is recessed; and
a sink groove at an outer side of the recessed position;
the installation platform protrudes toward the installation passage, and the inductor is fixed at the installation platform; and
the sink groove is configured to accommodate a connection member of the inductor or a grounding member of the electric control box.

8. The air conditioner of claim 7, wherein:
the inductor includes a base plate and an inductor body provided at the base plate;
an insertion member is formed at a lower end of the base plate;
the installation platform is provided with a slot corresponding to the insertion member; and
the insertion member is inserted in and connected to the slot.

9. The air conditioner of claim 6, wherein:
the electric control box further includes an electric control board mounted at the bottom plate and located above the inductor; and
the box cover is formed with:
a main cavity configured to accommodate components on the electric control board; and
an auxiliary cavity configured to accommodate the inductor.

10. The air conditioner of claim 9, wherein:
the electric control box further includes a heat sink mounted at one end of the electric control board and located above the inductor;
an accommodation groove is formed on an outer wall surface of the box cover at a position of the heat sink, and a groove wall of the accommodation groove is provided with an extension opening for the heat sink to extend into the accommodation groove;
an opening is formed on a top of the auxiliary cavity at a position corresponding to the accommodation groove; and
the electric control box further includes a metal cover configured to cover the opening.

11. The air conditioner of claim 10, wherein:
the outer metal box cover is provided with a slit extending from one side of the outer metal box cover to the opening and configured to adjust a position of the extension opening to correspond to the heat sink; and
the metal cover connects and fixes portions of the outer metal box cover located on two sides of the slit.

12. The air conditioner of claim 1, wherein:
the pre-positioning member includes:
a positioning frame connected to the box body of the electric control box; and
a plug board provided at a lower end of the positioning frame and extending laterally;
the socket of the chassis is provided with an insertion hole configured for the plug board to be inserted in; and
the insertion hole of the socket is flared and includes a guide flange extends obliquely upward on an upper edge of the insertion hole.

13. The air conditioner of claim 12, wherein:
a connection rib is provided at the pre-positioning member and includes:
a first rib extending from a side of the positioning frame in an up-down direction; and
a second rib extending from a lower end of the first rib to an upper surface of the plug board;
the upper surface of the plug board is provided with a horizontal rib;
the horizontal rib intersects the second rib vertically and horizontally; and
the horizontal rib is configured to abut against an upper wall surface of the insertion hole for positioning.

14. The air conditioner of claim 1, wherein:
the bottom of the electric control box is provided with a support structure for abutting against the chassis; and
a plurality of heat dissipation channels are formed on the support structure and configured for air circulation.

15. The air conditioner of claim 14, wherein:
the bottom plate includes an outer metal bottom plate and an inner plastic bottom plate, and the box cover includes an outer metal box cover and an inner plastic box cover; and
the support structure includes at least one of:
a first support member provided at a lower end of the inner plastic box cover; or
a second support member provided at a lower end of the inner plastic bottom plate.

16. The air conditioner of claim 15, wherein:
the first support member includes:
a plurality of support plates spaced apart from each other along a length direction of the electric control box, a heat dissipation channel being formed between two adjacent support plates of the plurality of support plates;
a horizontal partition plate connecting the two adjacent support plates and dividing the heat dissipation channel into an upper sub-channel and a lower sub-channel;

a vertical partition plate disposed at a ventilation surface of the upper sub-channel and including a ventilation hole communicated with the upper sub-channel; and a notch groove is provided at a side edge of the horizontal partition plate away from the vertical partition plate.

17. The air conditioner of claim 1, wherein:

a top plate of the housing is provided with a first fixation member located above the electric control box;

a first engagement member protrudes from a top of the electric control box and is connected and fixed to the first fixation member via a first connection member;

the top plate of the housing is further provided with a second fixation member and a third fixation member;

a fan bracket is provided in the housing, a second engagement member and a third engagement member protruding from a top surface of the fan bracket;

the second engagement member is connected and fixed to the second fixation member via a second connection member; and the third engagement member is connected and fixed to the third fixation member via a third connection member.

18. The air conditioner of claim 17, wherein:

the electric control box includes a box cover including an inner plastic box cover;

the inner plastic box cover of the electric control box is provided with a groove corresponding to the first engagement member; and a back of the inner plastic box cover is provided with a drainage groove extending downward from the groove to a bottom of the inner plastic box cover.

19. The air conditioner of claim 1, wherein:

the air conditioner is a window air conditioner configured to be installed at a window of a wall;

the housing of the window air conditioner is configured with a separation groove for a shielding member located at the window to extend into;

the indoor housing and the outdoor housing are separated by the separation groove, an indoor cavity is formed inside the indoor housing, and an outdoor cavity is formed inside the outdoor housing; and the electric control box is vertically installed on the outdoor housing.

20. The air conditioner of claim 19, further comprising:

a sealing member movably mounted in the separation groove and switchable between;

a storage state in which the sealing member is stored in the separation groove; and a working state in which the sealing member protrudes laterally from the separation groove to allow at least one of the shielding member or an inner wall of the window to abut against.

* * * * *